US006714190B2

(12) United States Patent
Nakano

(10) Patent No.: US 6,714,190 B2
(45) **Date of Patent: *Mar. 30, 2004**

(54) IMAGE DISPLAY CONTROL METHOD AND APPARATUS, AND DISPLAY APPARATUS

(75) Inventor: Masaki Nakano, Ebina (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,938

(22) Filed: Feb. 22, 2000

(65) Prior Publication Data

US 2003/0025717 A1 Feb. 6, 2003

(30) Foreign Application Priority Data

Feb. 26, 1999 (JP) ..... 11-096739

(51) Int. Cl.[7] ..... G09G 5/00
(52) U.S. Cl. ..... 345/204; 345/211; 345/690
(58) Field of Search ..... 345/589, 593, 345/594, 617, 88, 204, 690, 211, 212, 213, 214

(56) References Cited

U.S. PATENT DOCUMENTS

| | | | | | |
|---|---|---|---|---|---|
| 4,178,608 | A | * | 12/1979 | Shirato | 358/21 |
| 4,516,118 | A | * | 5/1985 | Wahlquist | 340/703 |
| 4,626,892 | A | * | 12/1986 | Nortrup et al. | 358/21 |
| 4,907,082 | A | * | 3/1990 | Richards | 358/143 |
| 5,191,421 | A | * | 3/1993 | Hwang | 358/168 |
| 5,270,821 | A | * | 12/1993 | Samuels | 358/188 |
| 5,276,458 | A | * | 1/1994 | Sawdon | 345/132 |
| 5,517,212 | A | * | 5/1996 | Inoue | 345/211 |
| 5,532,719 | A | * | 7/1996 | Kikinis | 345/211 |
| 5,602,567 | A | * | 2/1997 | Kanno | 345/698 |
| 5,880,702 | A | | 3/1999 | Morimoto et al. | 345/1 |
| 6,129,602 | A | * | 10/2000 | Yamanobe | 445/24 |
| 6,304,236 | B1 | * | 10/2001 | Arai et al. | 345/10 |

FOREIGN PATENT DOCUMENTS

| | | |
|---|---|---|
| JP | 8-123378 | 5/1996 |
| JP | 8-328516 | 12/1996 |
| JP | 2000-250500 | 9/2000 |
| JP | 2000-250503 | 9/2000 |
| JP | 2000-250525 | 9/2000 |
| JP | 2000-253330 | 9/2000 |
| JP | 2000-253425 | 9/2000 |

* cited by examiner

*Primary Examiner*—Steven Saras
*Assistant Examiner*—Alecia D. Nelson
(74) *Attorney, Agent, or Firm*—Fitzpatrick, Cella, Harper & Scinto

(57) ABSTRACT

Disclosed is a display apparatus including a display unit having a display panel, and a display controller for outputting an image signal to the display unit to thereby display an image on the display unit. If an indication to perform an adjustment of image quality enters from a wireless controller and the indicated adjustment is adjustment of brightness, contrast or color temperature, it is judged that the adjustment is to be performed by the display unit, the indication of the image quality adjustment is converted to a command and the command is transmitted to the display unit. In response, the display unit analyzes the received command and executes the image quality adjustment indicated by the command. If the indicated adjustment of image quality is other than the above, e.g., an image quality adjustment relating to chromaticity or hue, then the adjustment is executed by an image processor of the display controller and an image signal obtained by this image quality adjustment is transmitted to the display unit, whereby the image represented by this image signal is displayed.

32 Claims, 20 Drawing Sheets

FIG. 2

| ITEM | CONTENT | FORMULAE FOR RGB DATA | CONCEPTUAL VIEW |
|---|---|---|---|
| BRIGHTNESS | VARIES DC LEVEL OF Y SIGNAL (i.e., APPLY DC OFFSET). NOTE : Y SIGNAL (R, G, B SIGNALS) ARE POSITIVE VALUES ONLY | $Rout=R+\alpha$<br>$Gout=G+\alpha$<br>$Bout=B+\alpha$<br>($\alpha$:−50IRE%~+50IRE) | |
| CONTRAST | VARIES AMPLITUDE OF Y SIGNAL. IDEALLY VARIES AMPLITUDE ABOUT 50 IRE AS CENTER. NOTE : Y SIGNAL (R, G, B SIGNALS) ARE POSITIVE VALUES ONLY | $Rout=\alpha R$<br>$Gout=\alpha G$<br>$Bout=\alpha B$<br>($\alpha$:50%~200%) | |
| CHROMA-TICITY | VARIES AMPLITUDE OF C SIGNAL OR UV SIGNAL. NOTE : C SIGNAL AND UV SIGNAL BOTH TAKE ON POSITIVE AND NEGATIVE VALUES | $Rout=\alpha R+(1-\alpha)Y$<br>$Gout=\alpha G+(1-\alpha)Y$<br>$Bout=\alpha B+(1-\alpha)Y$<br>($Y=0.30R+0.59G+0.11B$)<br>($\alpha$:50%~200%) | |
| HUE OR TINT | VARIES PHASE ANGLE WHEN C SIGNAL IS DEMODULATED. NOTE : C SIGNAL AND UV SIGNAL BOTH TAKE ON POSITIVE AND NEGATIVE VALUES | $Rout=R\cos\theta-B\sin\theta+Y(1+\sin\theta-\cos\theta)$<br>$Gout=Y-Rout-Bout$<br>$Bout=R\sin\theta+B\cos\theta+Y(1-\sin\theta-\cos\theta)$<br>($Y=0.30R+0.59G+0.11B$)<br>($\alpha$:−30° ~+30°) | R, R-Y, B-Y, B, G |
| COLOR TEMP | VARIES BALANCE OF R AND B SIGNALS WHILE G SIGNAL IS KEPT FIXED. NOTE : R, G, B SIGNALS ARE POSITIVE VALUES ONLY | $Rout=\alpha\times R$<br>$Gout=G$<br>$Bout=(1/\alpha)\times R$<br>($\alpha$:70%~140%) | R G B |
| EMPHASIS | EMPHASIZES CONTOURS. WITH CRTs, PROCESSING GENERALLY IS IN HORIZONTAL DIRECTION ONLY. USUALLY APPLIED TO Y SIGNAL ONLY | $Qout=Q-\alpha Q_{-1}-\alpha Q_{+1}$<br>$Q_{-1}$: DATA ONE PIXEL EARLIER (NEIGHBORING ON LEFT)<br>$Q_{+1}$: DATA ONE PIXEL LATER (NEIGHBORING ON RIGHT)<br>($\alpha$ : 0%~30%) | Q<br>$-\alpha Q_{-1}$<br>$-\alpha Q_{+1}$<br>Qout=<br>$Q-\alpha Q_{-1}-\alpha Q_{+1}$ |

IMAGE DISPLAY CONTROL METHOD AND APPARATUS, AND DISPLAY APPARATUS

FIELD OF THE INVENTION

This invention relates to an image display control method and apparatus for outputting an image display signal to a display apparatus to display an image on the apparatus, and to the display apparatus.

BACKGROUND OF THE INVENTION

In a known display apparatus having a display controller and a display unit, image quality (indicating the quality of a displayed image being changed by adjusting color, brightness and contrast, and the like) can be adjusted upon receiving a signal sent from a wireless controller (utilizing an infrared light) or the like. With such an apparatus, the color adjustment of the displayed image usually is performed using a dedicated image processing circuit and the like.

In a case where the adjustment of the image quality such as brightness and contrast of a displayed image is performed, control can be performed independently for each of the colors R, G, B. However, in a case where the adjustment of the image quality such as chromaticity or hue of displayed image is performed, it is required that each pixel be calculated using all three of the R, G, B data. This leads to greater hardware load and to an increase in the scale of the hardware.

SUMMARY OF THE INVENTION

Accordingly, an object of the present invention is to provide an image display control method and apparatus, as well as a display apparatus, in which implementation of adjustment functions is shared by a display controller and display unit in accordance with the type of image quality adjustment indication designated, thereby preventing a decline in image quality and making it possible to adjust the image quality of a displayed image.

Another object of the present invention is to provide an image display control method and apparatus, as well as a display apparatus which has a display unit and a display controller for controlling display by outputting an image signal and a synchronizing signal to the display unit, wherein among image quality adjustments that have been designated, adjustment of brightness, contrast and color temperature of a displayed image is performed by the display unit and image quality adjustments other than these are performed by the display controller, whereby an increase in the scale of hardware is suppressed and designated image quality adjustments can be performed efficiently.

According to the present invention, the foregoing objects are attained by providing an image display control apparatus for outputting an image signal to a display unit to display an image on the display unit, comprising: input means for inputting an image quality adjustment designation for designating adjustment of image quality of an image displayed on the display unit; determination means for determining whether the image quality adjustment designation input by the input means designates an image quality adjustment that is to be performed by the display unit; command transmitting means for converting an image quality adjustment designation, which the determination means has determined designates an image quality adjustment to be performed by the display unit, to a command and transmitting the command to the display unit; image processing means for processing an image signal to thereby execute image quality adjustment and outputting processed image signal; and output means for outputting, to the display unit, the processed image signal produced by the image processing means by executing an image quality adjustment other than that of the image quality adjustment designation that the determination means has determined is to be performed by the display unit.

According to the present invention, the foregoing objects are attained by providing an image display control method for outputting an image signal to a display unit to display an image on the display unit, comprising: an input step of inputting an image quality adjustment designation for designating adjustment of image quality of an image displayed on the display unit; a determination step of determining whether the image quality adjustment designation input at the input step designates an image quality adjustment that is to be performed by the display unit; a command transmitting step of converting the image quality adjustment designation, which the designating step has determined designates an image quality adjustment to be performed by the display unit, to a command and transmitting the command to the display unit; an image processing step of executing an image quality adjustment other than that of the image quality adjustment designation that the determination step has determined is to be performed by the display unit; and an output step of outputting, to the display unit, an image signal an image signal processed at the image processing step.

Further, the present invention provides a display apparatus having a display controller and a display unit for displaying an image based upon an image signal from the display controller, wherein the display controller comprises: input means for inputting an image quality adjustment designation for designating adjustment of image quality of an image displayed on the display unit; determination means for determining whether the image quality adjustment designation input by the input means designates an image quality adjustment that is to be performed by the display unit; command transmitting means for converting an image quality adjustment designation, which the determination means has determined designates an image quality adjustment to be performed by the display unit, to a command and transmitting the command to the display unit; image processing means for processing an image signal to thereby execute image quality adjustment; and output means for outputting, to the display unit, a signal produced by the image processing means by executing an image quality adjustment other than that of the image quality adjustment designation that the determination means has determined is to be performed by the display unit;

and the display unit comprises: command analyzing means for analyzing the command that has been transmitted by the command transmitting means; and image quality adjusting means for adjusting displayed image quality in accordance with the image quality adjustment designation that is based upon the command analyzed by the command analyzing means.

It is preferred that if an image signal in the present invention contains R, G, B signals and each of the R, G, B signals can be processed independently to thereby execute the designated image quality adjustment, then a determination is made to the effect that the designated image quality adjustment is to be performed by the display unit.

It is preferred that if the display unit has an image quality adjustment function, then a determination is made to the effect that the designated image quality adjustment is to be performed by the display unit.

It is preferred that if the designated image quality adjustment is an adjustment of brightness, contrast or color temperature, then a determination is made to the effect that the designated image quality adjustments to be performed by the display unit.

It is preferred that if the designated image quality adjustment is a change of chromaticity or hue or emphasis of contour, then a determination is made to the effect that the image quality adjustment is to be performed by image processor of the display controller.

It is preferred that the display unit has a display panel which includes surface-conduction type of emission devices.

It is preferred that the display unit include a CRT.

It is preferred that the image quality adjustment designation be made by an infrared signal from a wireless controller.

It is preferred that the display unit analyze a command that has been transmitted to it and perform the image quality adjustment, which is based upon the analyzed command, by changing pulse width of a display driving signal.

It is preferred that the display unit analyze a command that has been transmitted to it and perform the image quality adjustment, which is based upon the analyzed command, by changing driving current of a display driving signal.

It is preferred that the display unit analyze a command that has been transmitted to it and perform the image quality adjustment, which is based upon the analyzed command, by changing number of pulses of a display driving signal.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

FIG. 2 is a diagram useful in describing the content of processing executed by a digital image processing unit in a controller according to this embodiment;

DESCRIPTION OF THE PREFERRED EMBODIMENTS

Preferred embodiments of the present invention will now be described in detail with reference to the accompanying drawings.

First Embodiment

Figure 1:
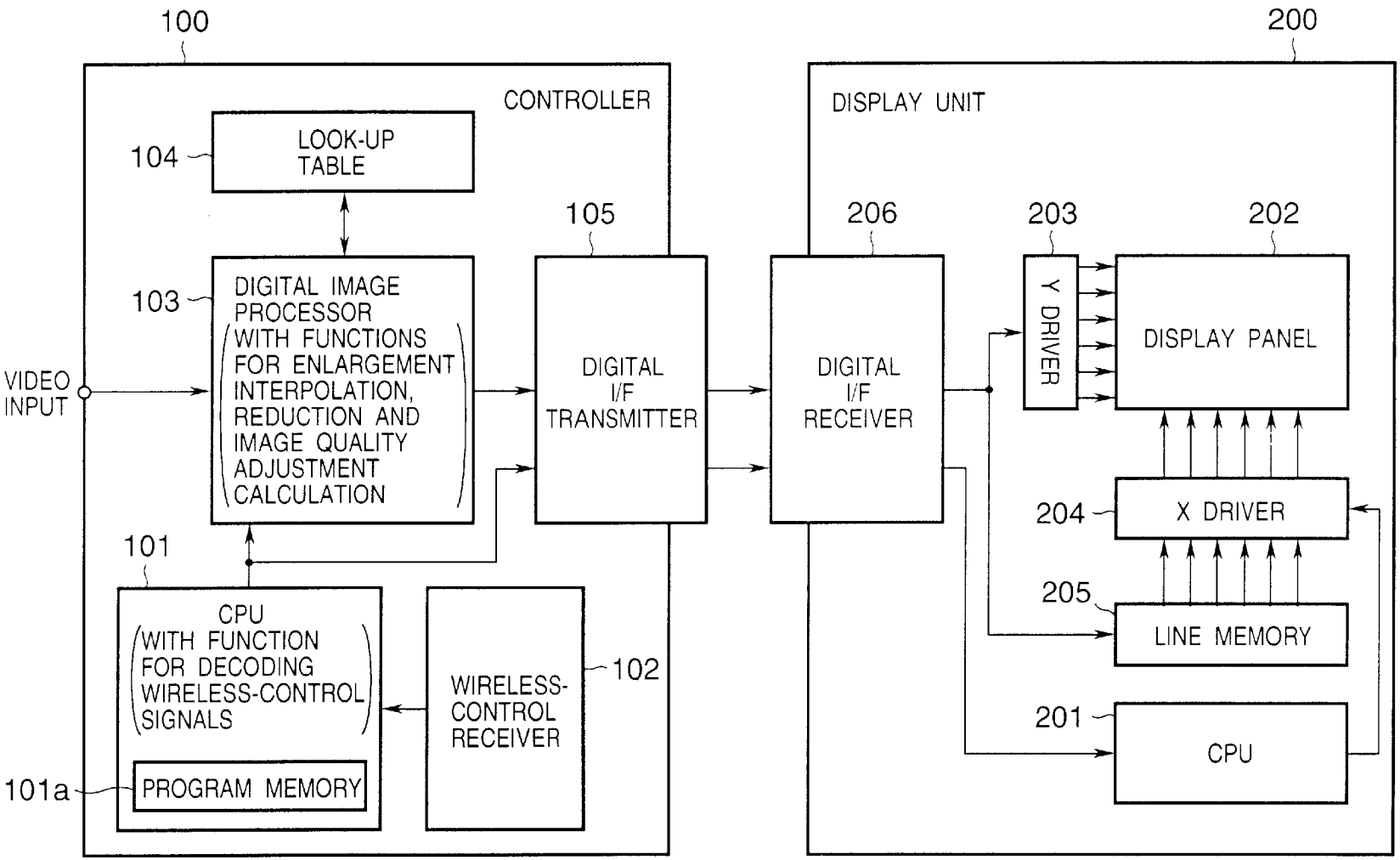
FIG. 1 is a block diagram illustrating the construction of an image display apparatus according to a first embodiment of the present invention.

FIG. 1 is a block diagram illustrating the construction of a display apparatus according to a first embodiment of the present invention. The display apparatus includes a controller 100 and a display unit 200 such as a flat-panel display. The controller 100 receives a video signal, processes the signal and outputs the processed image signal to the display unit 200, and the display unit 200 accepts the image signal sent from the controller 100 and displays the image represented by the image signal.

The construction of the controller 100 will be described first.

The controller 100 includes a CPU 101 for controlling the operation of the controller 100. The CPU 101 executes various processing for control in accordance with a control program that has been stored in a program memory 101*a*. The controller 100 further includes a wireless-control receiver 102 for receiving infrared light from a wireless controller (not shown) operated by an operator, extracting data contained in the infrared light and outputting the extracted data to the CPU 101. As a result, the CPU 101 analyzes the data and controls a digital image processor 103 and a digital interface (I/F) transmitter 105 in dependence upon the results of analysis. A look-up table 104 stores various data referred to when image processing is executed by the digital image processor 103. It should be noted that the image processing executed by the digital image processor 103 includes processing for functions such as enlargement interpolation, reduction and calculation for image quality adjustment. The details will be described in detail later with reference to FIG. 2. The digital interface transmitter 105 transmits an image signal, which has been processed by the digital image processor 103, to the display unit 200 together with the synchronizing signals of the image signal. It also sends the display unit 200 a command conforming to the results of analysis of the wireless-control data by the CPU 101.

Examples of the video signal input to the controller 100 are an NTSC television signal or the like or a digital signal such an RGB signal, and there may be more than one path on which the video signal enters the controller.

The construction of the display unit 200 will be described next.

The display unit 200 includes a CPU 201 for controlling the overall operation of the display unit 200, and a display panel 202. According to this embodiment, the display panel 202 is a flat-panel display having electron emission devices arrayed in the form of a matrix, for example, and phospors which emit light in response to electrons emitted from the electron emission devices. A Y-driver 203 drives the scanning-direction (row direction) wires of the display panel 202 and an X-driver 204 drives the column-direction wires of the display panel 202 in dependence upon one line of image data that has been stored in a line memory 205. A digital interface (I/F) receiver 206 receives an image signal, command and synchronizing signals sent from the digital interface transmitter 105 of the controller 100, applies the command and synchronizing signals to the CPU 201, drives the Y-driver 203 in conformity with the synchronizing signals and outputs the image signal to the line memory 205, where the image signal is stored. It should be noted that the line that connects the digital interface transmitter 105 and receiver 206 is a digital-interface dedicated line on which commands and image signals are transmitted as serial data. An adjustment value set by a user operating the wireless controller is stored in a non-volatile memory (not shown) of the CPU 101 in the controller 100 and in a non-volatile memory (not shown) of the CPU 201 in the display unit 200.

FIG. 2 is a diagram useful in describing the image processing functions of the digital image processor 103 of controller 100.

The image processing functions of the digital image processor 103 include functions relating to brightness, contrast, chromaticity, hue, color temperature and contour emphasis, and the units for implementing these functions are serially connected. Each type of control is executed based upon a control signal from the CPU 101. FIG. 2 illustrates each type of image processing, the content of the processing, the calculation formulae in the case of RGB data and the processing concept. As these types of processing are all well known, a detailed description thereof is omitted.

Figure 3:
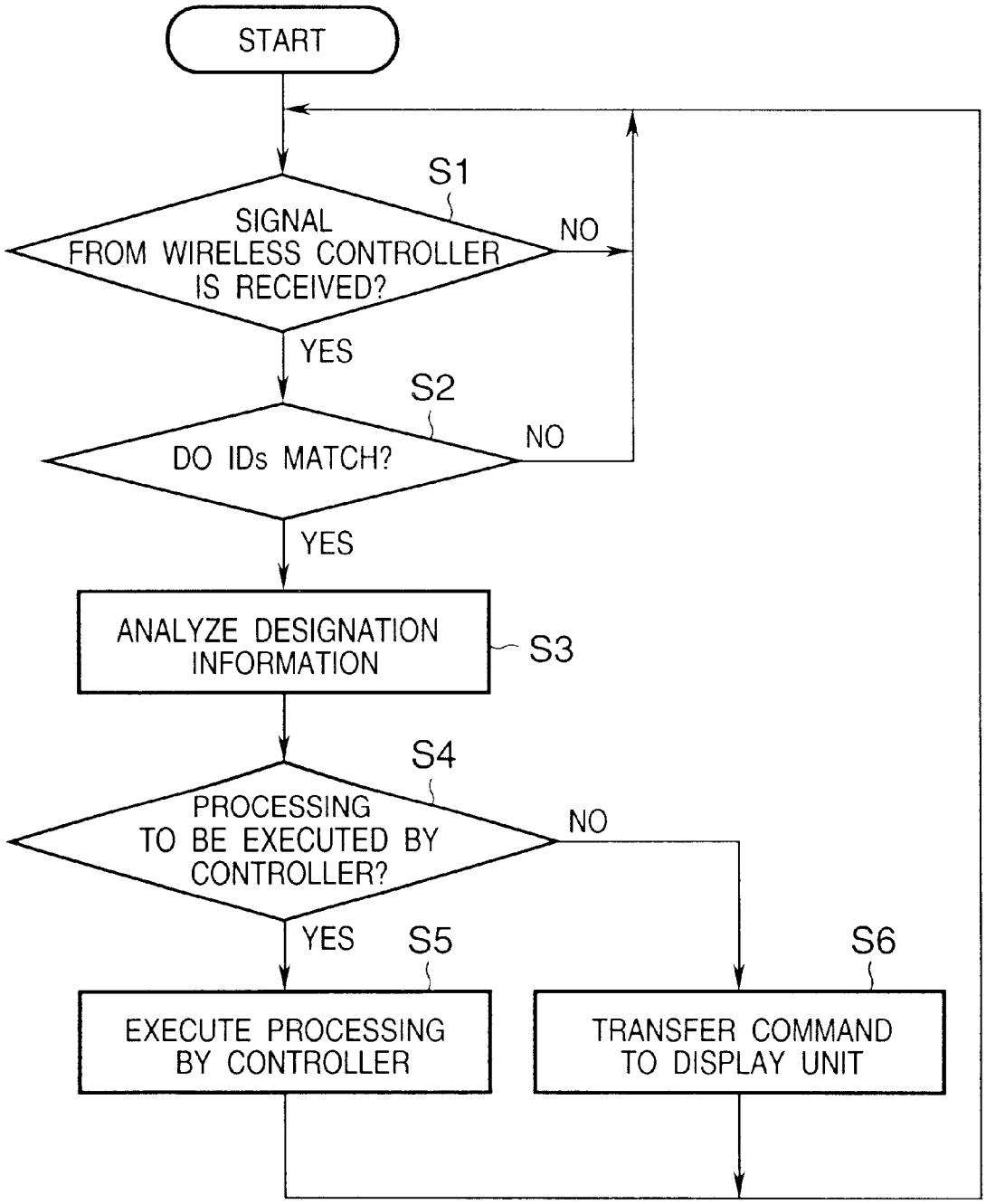
FIG. 3 is a flowchart illustrating processing executed by a controller in the image display apparatus according to the first embodiment.

FIG. 3 is a flowchart illustrating processing executed by the CPU 101 of the controller 100 according to the first embodiment of the present invention. The program for executing this processing is stored in the program memory 101*a*. It should be noted that the processing illustrated by the flowchart assumes that the controller 100 has already recognized the type of display unit 200 connected to it.

Step S1 of the flowchart calls for the CPU 101 to determine whether a signal has been received by the wireless-control receiver 102. If a signal has been received, control proceeds to step S2, at which the CPU 101 determines whether the ID contained in the wireless-control signal matches a wireless-controller ID capable of being received by the controller 100. If the two do not match, control returns to step S1 without execution of any further processing. If a match is obtained, however, control proceeds to step S3, at which designation information contained in the wireless-control signal is analyzed. This is followed by step S4, at which the CPU 101 determines whether the designation made by the wireless controller is designation of a brightness, contrast or color-temperature adjustment. If such is the case, adjustment information is stored in the memory of the CPU 101 and control proceeds to step S6 because it is judged that the adjustments are to be made by the display unit 200. Here a command is created based upon the designation signal from the wireless-control receiver 102 and is transmitted to the display unit 200 via the transmitter 105.

If it is judged at step S4 that the designation from the wireless controller is a designation relating to chromaticity, hue or contour emphasis, control proceeds to step S5 by reason of the fact that execution of these adjustments by the controller 100 is appropriate. The designation information is stored in the memory (not shown) of the CPU 101 and a command is output to the digital image processor 103 to cause the digital image processor 103 to execute the designated image processing.

Figure 4:
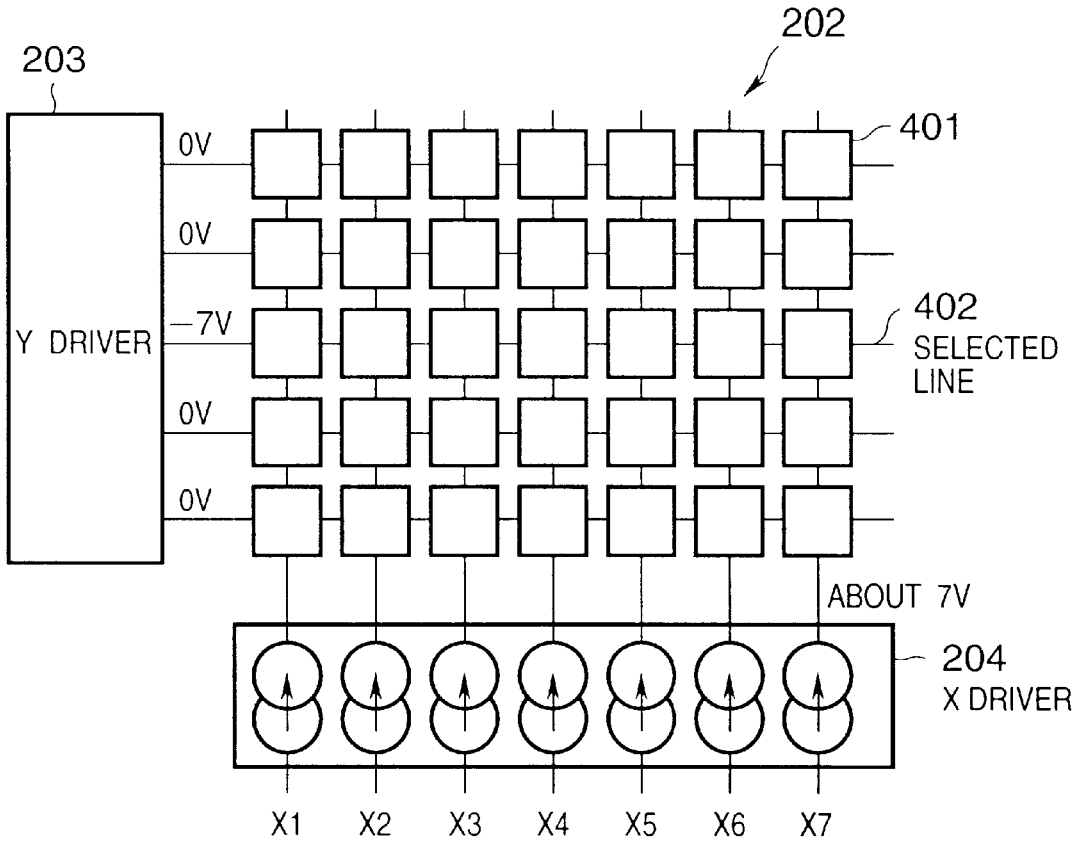
FIG. 4 is a diagram useful in describing the connection between a display panel and X, Y drivers according to this embodiment.

FIG. 4 is a block diagram showing the construction of the display panel 202 according to this embodiment. The display panel 202 includes electron emission devices 401. Numeral 402 denotes a row wire selected from among row wires connected to the output of the Y-driver 203. Pulse-width modulated signals conforming to the image signal enter the display panel 202 from the X-driver 204.

Figure 5:
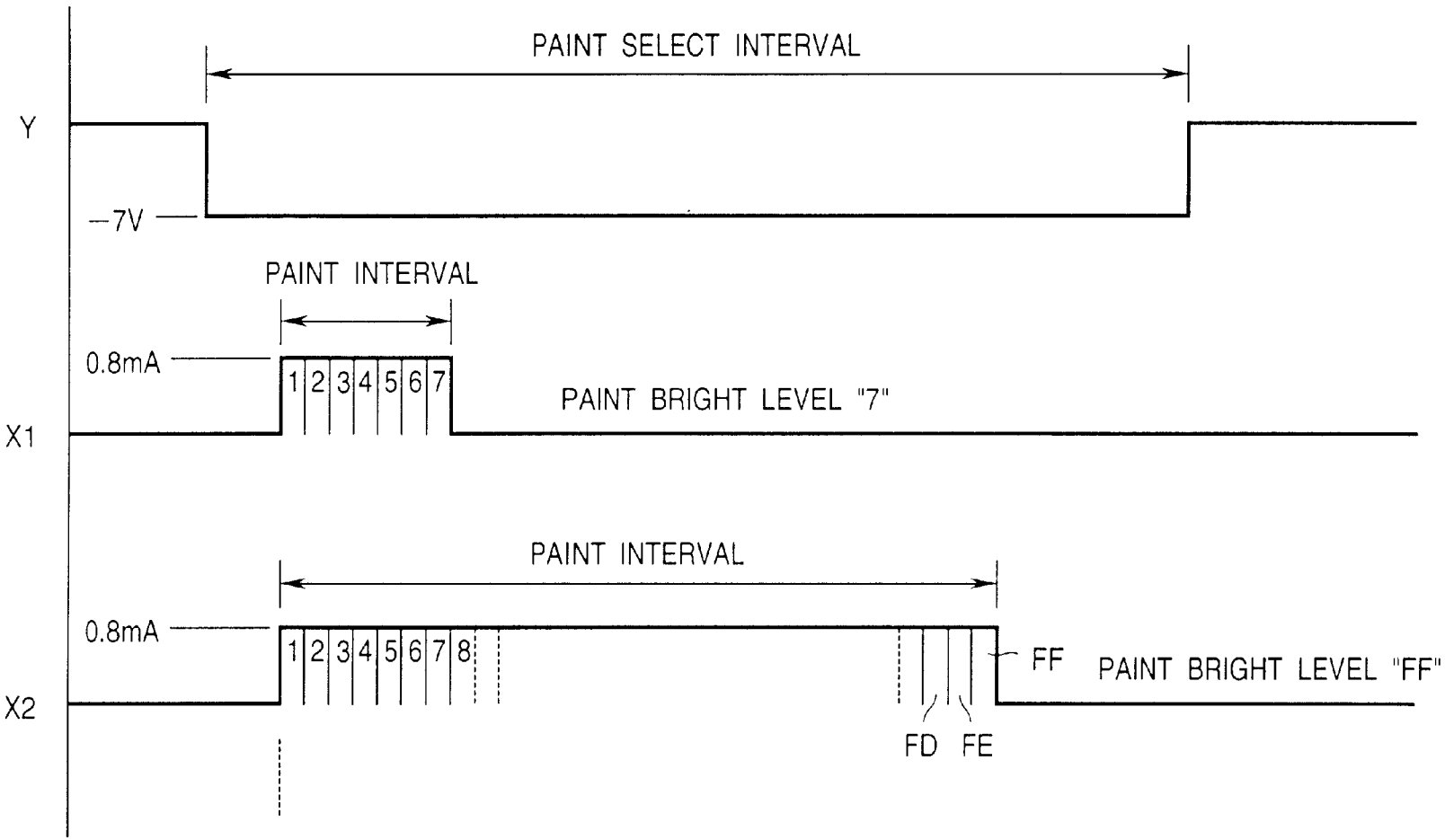
FIG. 5 is a diagram useful in describing output signals of the X and Y drivers.

FIG. 5 is a timing chart illustrating examples of waveforms of voltage signal (−7 V) applied to a selected row wire and of modulated signals output from the X-driver 204. Here a pulse-width modulated signal indicating a bright level "7" is applied to a column wire X1 and a pulse-width modulated signal indicating a bright level "0FFh" is applied to a row wire X2.

Figure 6:
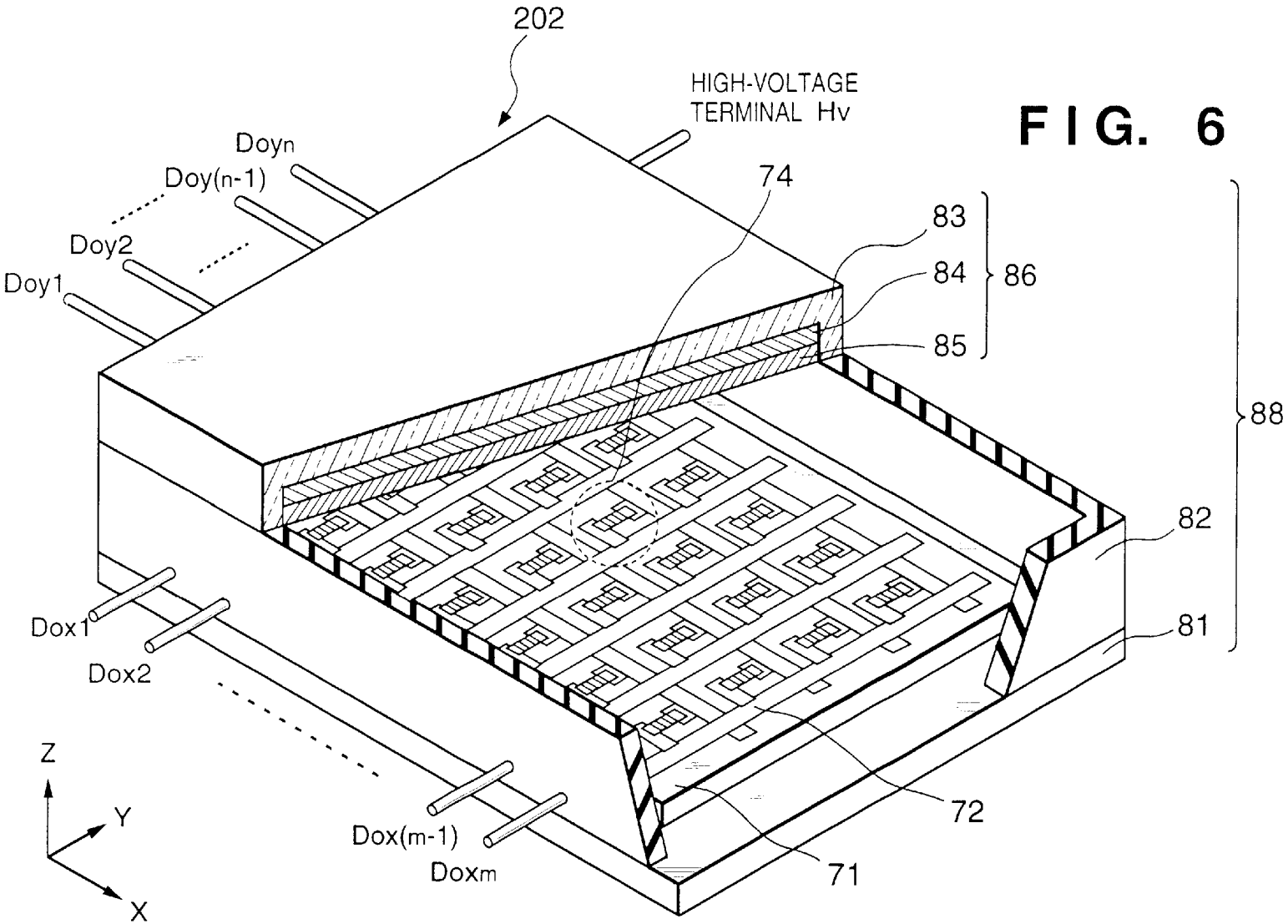
FIG. 6 is a perspective view illustrating an example of a display panel according to this embodiment.

FIG. 6 is a schematic view showing an example of the display panel 202 according to this embodiment. A portion of the panel is cut away in order to illustrate the internal structure thereof.

As shown in FIG. 6, the display panel 202 includes an electron-source substrate 71 on which a plurality of electron emission devices 74 are arrayed; a rear plate 81 to which the electron-source substrate 71 is secured; and a face plate 86 obtained by forming a phosphor film 84 and a metal back 85, etc., on the inner surface of a glass substrate 83. The rear plate 81 and face plate 86 are secured to a support frame 82 using a material such as frit glass having a low melting point. The electron emission devices 74 correspond to the electron emission device 401 of FIG. 4. Row wires 72 and column wires 73 are connected to respective ones of a pair of element electrodes of the electron emission devices 74.

An envelope 88 is constructed by the face plate 86, support frame 82 and rear plate 81. Because the rear plate 81 is provided mainly for the purpose of increasing the strength of the electron-source substrate 71, it can be dispensed with if the substrate 71 per se has enough mechanical strength. More specifically, the support frame 82 may be affixed directly to the substrate 71 and the envelope 88 may be constructed by the face plate 86, support frame 82 and substrate 71. By placing support members (not shown) referred to as spacers between the face plate 86 and rear plate 81, the envelope 88 constructed will having sufficient strength to resist atmospheric pressure.

Figure 7:
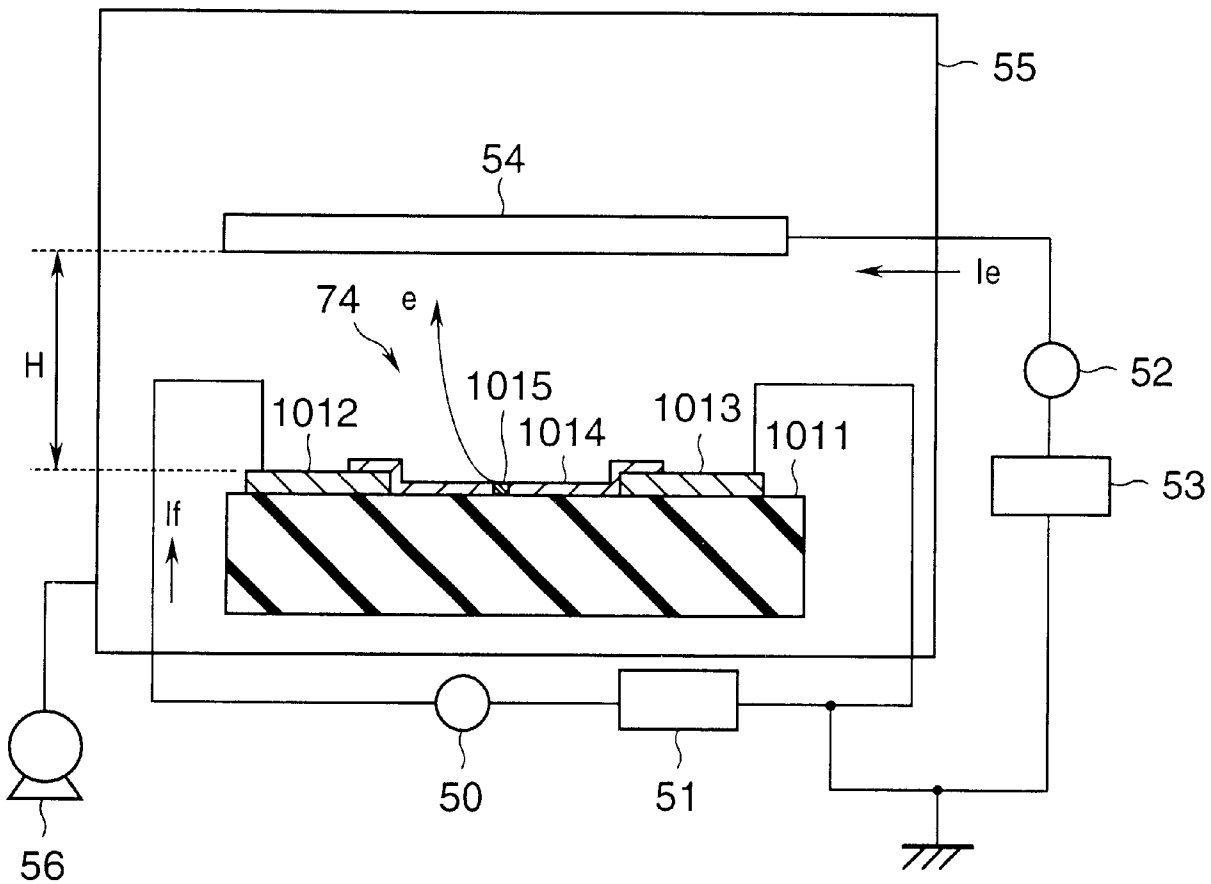
FIG. 7 is a schematic view illustrating an example of a vacuum treatment apparatus having functions for measuring and evaluating characteristics of electron emission elements according to this embodiment.

FIG. 7 is a schematic view illustrating an example of a vacuum treatment apparatus for measuring and evaluating the characteristics of the electron emission device 74 according to this embodiment.

As shown in FIG. 7, the apparatus includes a vacuum vessel 55 and an exhaust pump 56. The electron emission device 74 described above is disposed within the vacuum vessel 55. More specifically, shown in FIG. 7 are substrate 1101 on which the electron emission device is placed; element electrodes 1102, 1103; an electrically conductive thin film 1014; an electron emission portion 1015; a power supply 51 for applying an element voltage Vf to the electron emission device 74; an ammeter 50 for measuring an element current If that flows through the electrically conductive thin film 1014 between the element electrodes 1012, 1013; an anode electrode (which corresponds to the metal back 85 mentioned earlier) 54 for capturing the emission current Ie emitted from the electron emission portion 1015 of the element 74; a high-voltage power supply 53 for applying voltage to the anode electrode 54; and an ammeter 52 for measuring the emission current Ie emitted from the electron emission portion 1015 of the element 74. By way of example, measurement can be performed by adopting 1 to 10 kV as the range of voltage applied to the anode electrode 54 and adopting 2 to 8 mm as distance H between the anode electrode 54 and electron emission device 74.

Equipment such as a vacuum gauge (not shown) necessary for performing measurements under vacuum conditions is provided within the vacuum vessel 55 so that measurement and evaluation can be made under the desired vacuum conditions. The exhaust pump 56 comprises ordinary high-vacuum equipment such as a turbo-pump or rotary pump, and ultra-high-vacuum equipment such as an ion pump and the like. The entire vacuum treatment apparatus in which the electron-source substrate 1011 has been placed can be heated to about 250° C. by a heater, not shown. Accordingly, using this apparatus makes it possible to carry out a process in which the electron emission portion 1015 is formed on the electrically conductive thin film 1014 and the electron emission portion 1015 is activated to enhance the electron emission characteristic.

Figure 8:
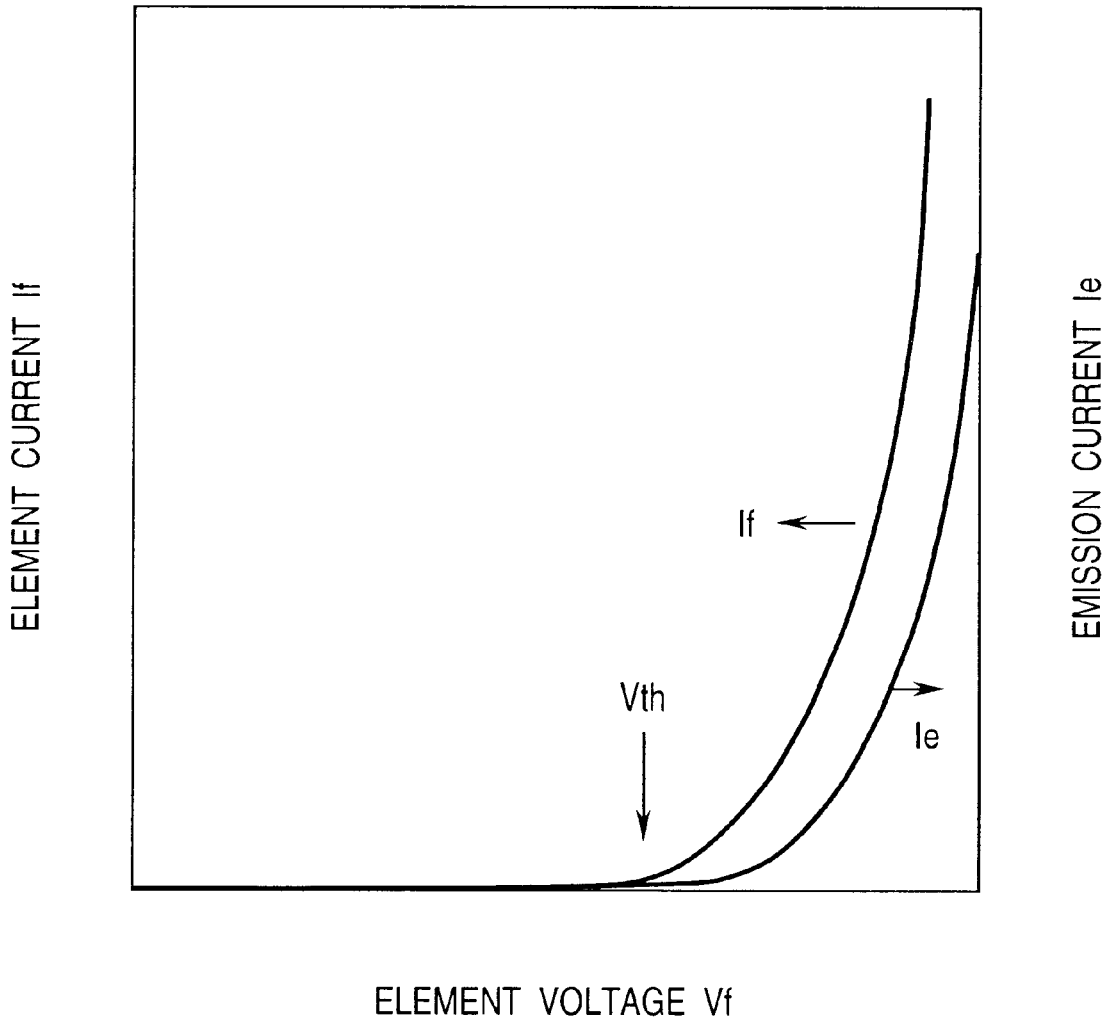
FIG. 8 is a graph showing an example of the relationship among emission current, element current and element voltage in a surface-conduction type of emission device according to this embodiment.

FIG. 8 is a graph showing an example of the relationship among the emission current Ie, element current If and element voltage Vf in a surface-conduction type of emission device according to this embodiment.

Since the emission current Ie is very small in comparison with the element current If, the units indicated in the graph of FIG. 8 are arbitrary. In addition, the vertical and horizontal axes are both linear scales. As should be evident from FIG. 8, the surface-conduction type of electron emission device according to this embodiment has the following three characterizing properties in regard to the emission current Ie:

(i) When an element voltage equal to or greater than a certain voltage (referred to as a threshold voltage Vth in FIG. 8) is applied to the device, the emission current Ie suddenly increases. When the applied voltage is less than the threshold voltage Vth, on the other hand, almost no emission current Ie is detected. In other words, the device is a non-linear element having the clearly defined threshold voltage Vth with respect to the emission current Ie.

(ii) Since the emission current Ie increases monotonously in dependence upon the element voltage Vf, the emission current Ie can be controlled by the element voltage Vf.

(iii) An emission charge captured by the anode electrode 54 is dependent upon the time during which the element voltage Vf is applied. In other words, the amount of electric charge captured by the anode electrode 54 can be controlled by the length of time over which the voltage Vf is applied.

The threshold voltage Vth of the surface-conduction type of emission device in this embodiment is 14 V. Accordingly, by applying −7 V to a selected row wire and applying a pulsed signal whose voltage value is +7 V to column wires at a pulse width that conforms to the value of the image signal (i.e., the bright-level data), as shown in FIG. 5, only electron emission devices connected to the selected row wire can be caused to emit electrons in an amount conforming to the value of the image signal.

Further, this adjustment of the amount of electrons emitted can be carried out not only by changing the pulse width of the pulse-width modulated signal by also changing the emission current that flows into the electron emission device.

Figure 9:
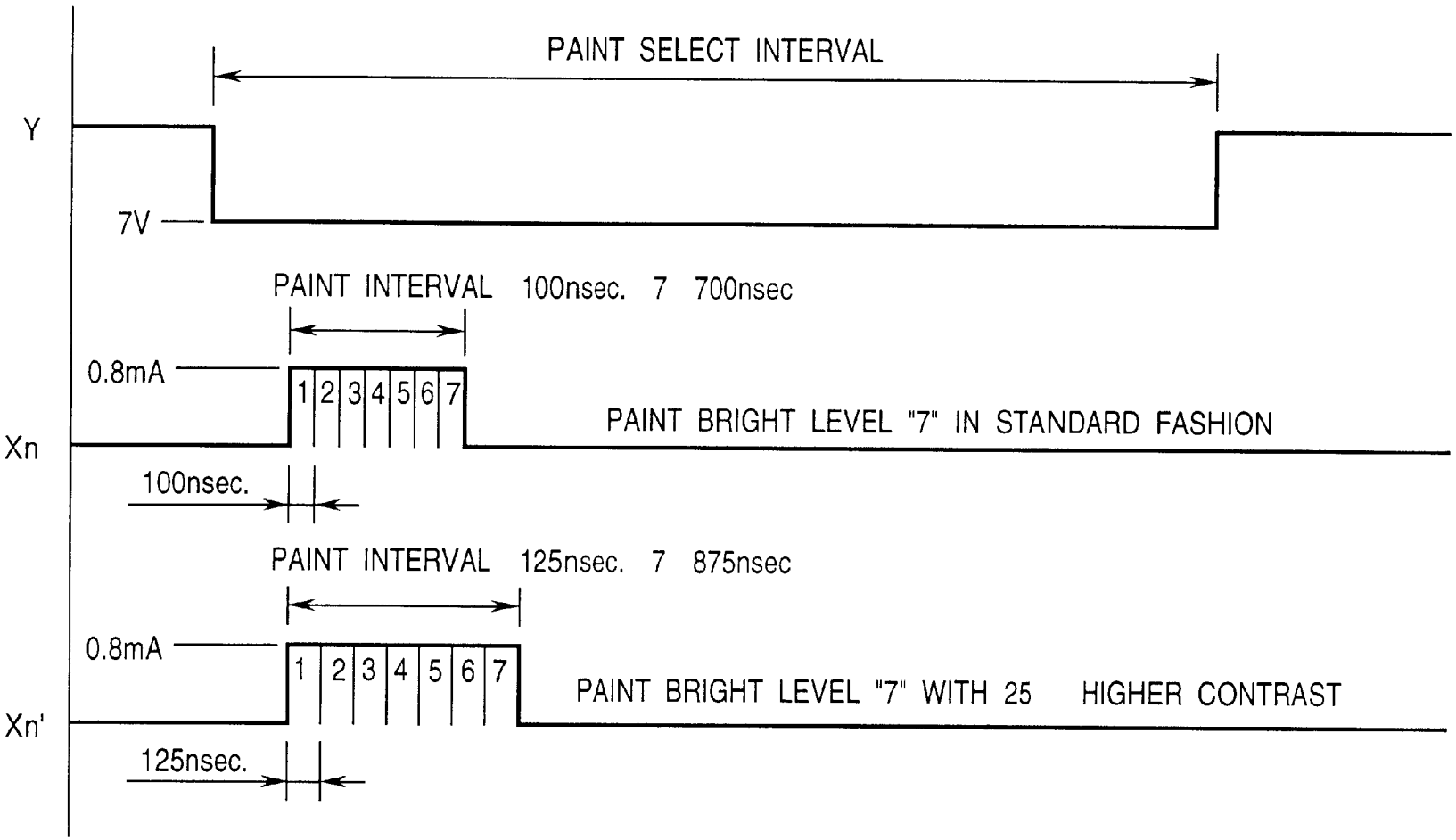
FIG. 9 is a diagram useful in describing an example in which contrast is adjusted by changing the pulse width of modulated pulses conforming to the bright level of an image signal.
Figure 10:
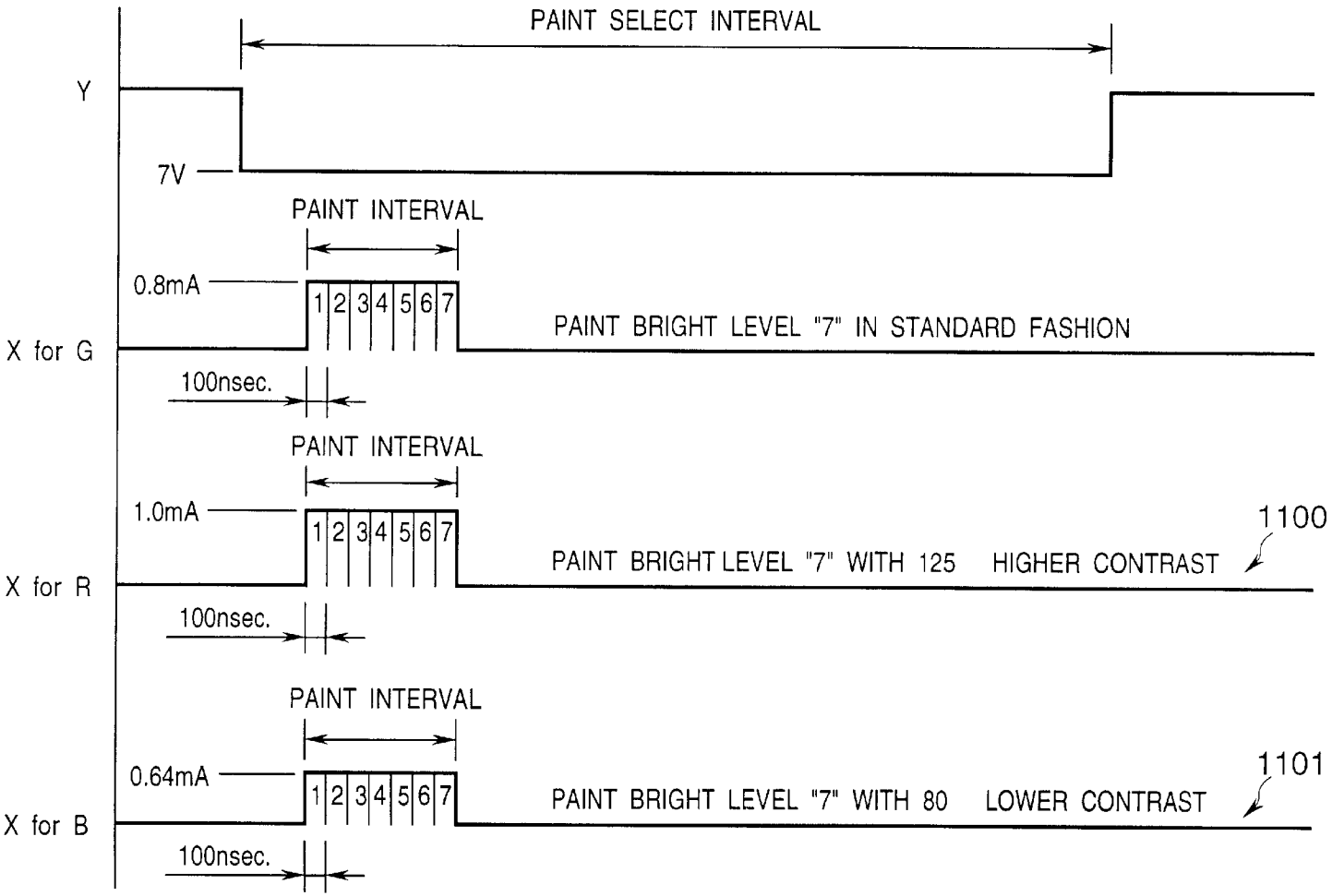
FIG. 10 is a diagram useful in describing an example in which contrast is adjusted by changing the driving current of modulated pulses conforming to the bright level of an image signal.
Figure 11:
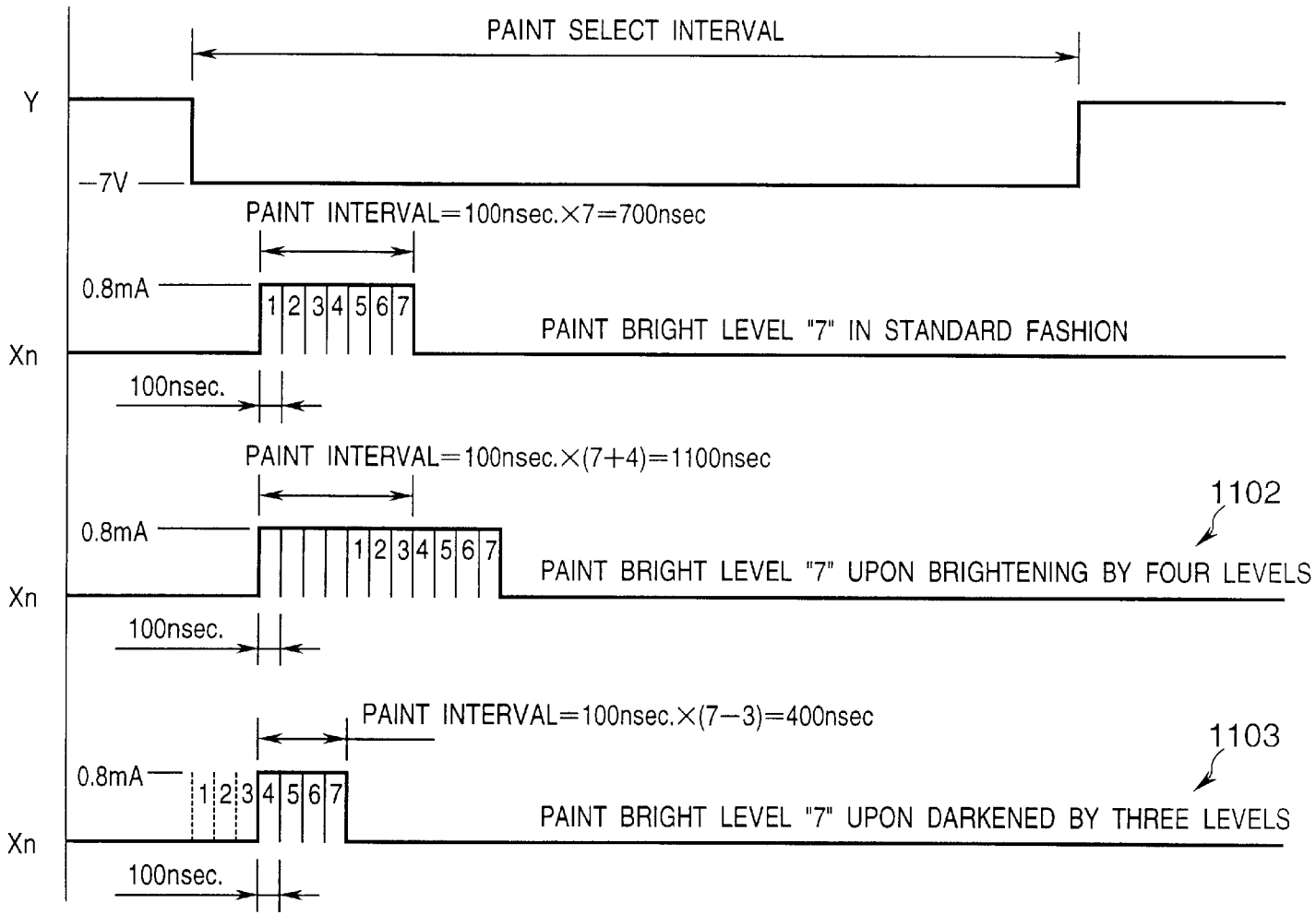
FIG. 11 is a diagram useful in describing an example in which brightness is adjusted by adding offset pulses onto modulated pulses conforming to the bright level of an image signal.

FIGS. 9 to 11 illustrate an example of this. FIG. 9 illustrates a case where a pixel of bright level "7" is displayed upon having its contrast raised by about 25%. Whereas the modulated pulse width is a standard 100 ns (indicated at Xn) per one bright level, display is controlled such that the modulated pulse width is raised by 25% to 125 ns (indicated at Xn') per bright level.

If the contrast of the pixel of bright level "7" is raised 25%, as shown in FIG. 10, the current value resulting from drive by the X-driver 204 is made 1.0 mA (for the color R indicated at 1100 in FIG. 10), which is 25% higher than the usual 0.8 mA. If the contrast of the pixel of bright level "7" is lowered 25%, the current value is made 0.64 mA (for the color B indicated at 1101 in FIG. 10), which is 25% lower than the usual 0.8 mA.

FIG. 11 illustrates an example in which brightness is adjusted by changing the number of pulses of the pulse-width modulated signal. Here the pixel of bright level "7", is brightened by four levels by increasing the seven pulses of bright level "7" by four pulses, as indicated at 1102, or the pixel of bright level "7" is darkened by three bright levels by reducing the seven pulses of bright level "7" by three pulses, as indicated at 1103.

Thus, in accordance with the first embodiment, as described above, displayed brightness, contrast and color temperature are adjusted by the display unit and other processing is executed by the controller, which outputs the image signal to the display unit. As a result, an increase in hardware can be prevented and so can a decline in image quality.

Second Embodiment

Figure 12:
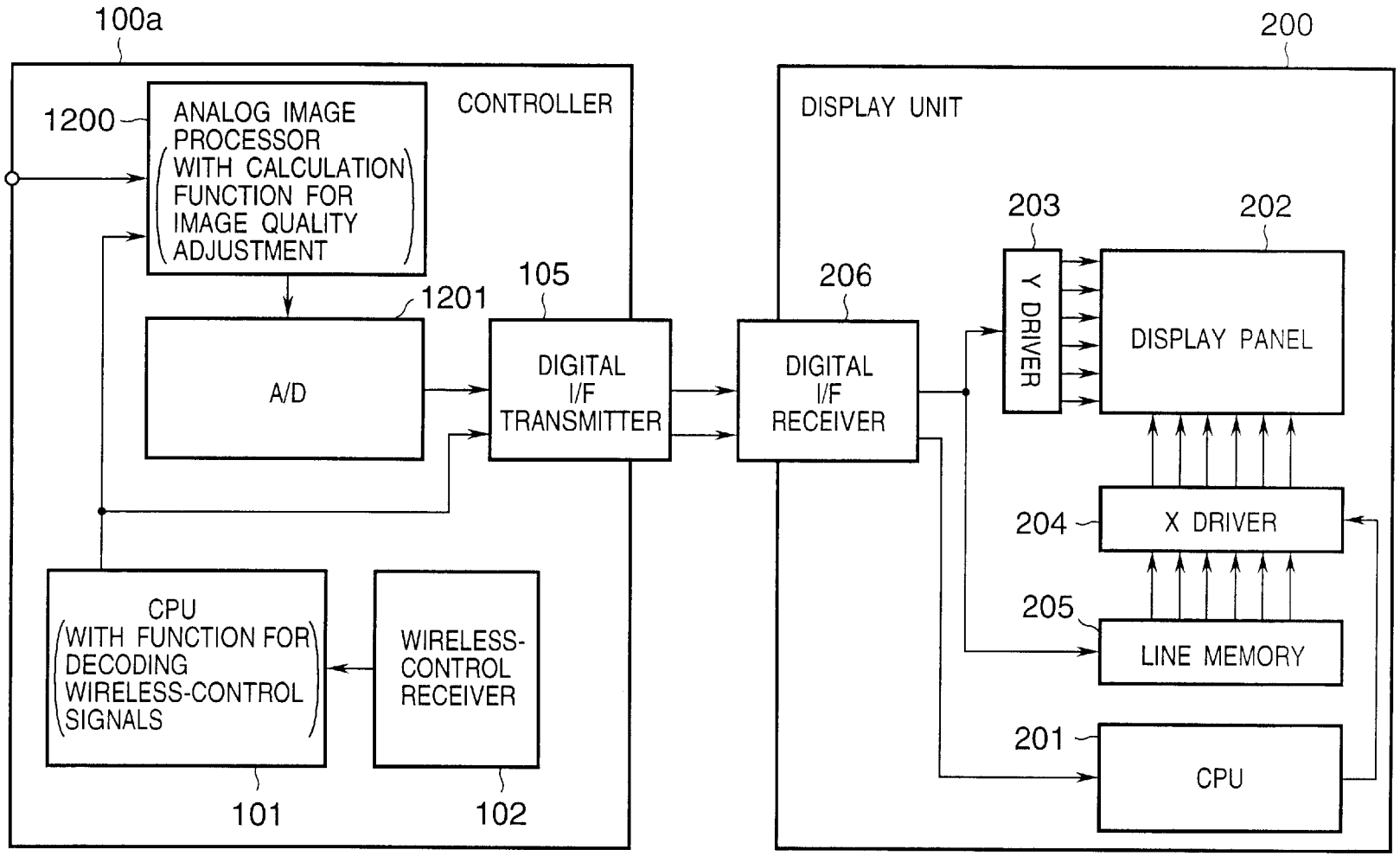
FIG. 12 is a block diagram illustrating the construction of an image display apparatus according to a second embodiment of the present invention.

FIG. 12 is a block diagram illustrating the construction of a display apparatus according to a second embodiment of the present invention. Components shown in FIG. 12 identical with those of FIG. 1 are designated by like reference characters and need not be described again.

According to the second embodiment, a controller **100*a* has an analog image processor 1200 and an A/D converter 1201 for converting an analog image signal, which has been processed by the analog image processor 1200, to a digital signal. Based upon a designation from the CPU 101, the analog image processor 1200** executes image processing such as chromaticity or hue adjustment, i.e., adjusts the image signal in analog fashion by changing the respective chrominance gains or by changing the fsc phase to the chrominance decoders (not shown).

As in the first embodiment, the second embodiment also is such that processing is executed in accordance with wireless-control information received by the wireless-control receiver 102, and the CPU 101 determines whether the designated processing is to be executed by the controller 100*a* or by the display unit 200 and performs control upon outputting a command to the controller 100*a* or the display unit 200. As these operations are similar to those of the first embodiment, they need not be described again.

Thus, in accordance with the second embodiment, chromaticity and hue, etc., can be controlled with the image signal in the form of an analog image signal. This makes it possible to simplify the circuit arrangement.

Third Embodiment

Figure 13:
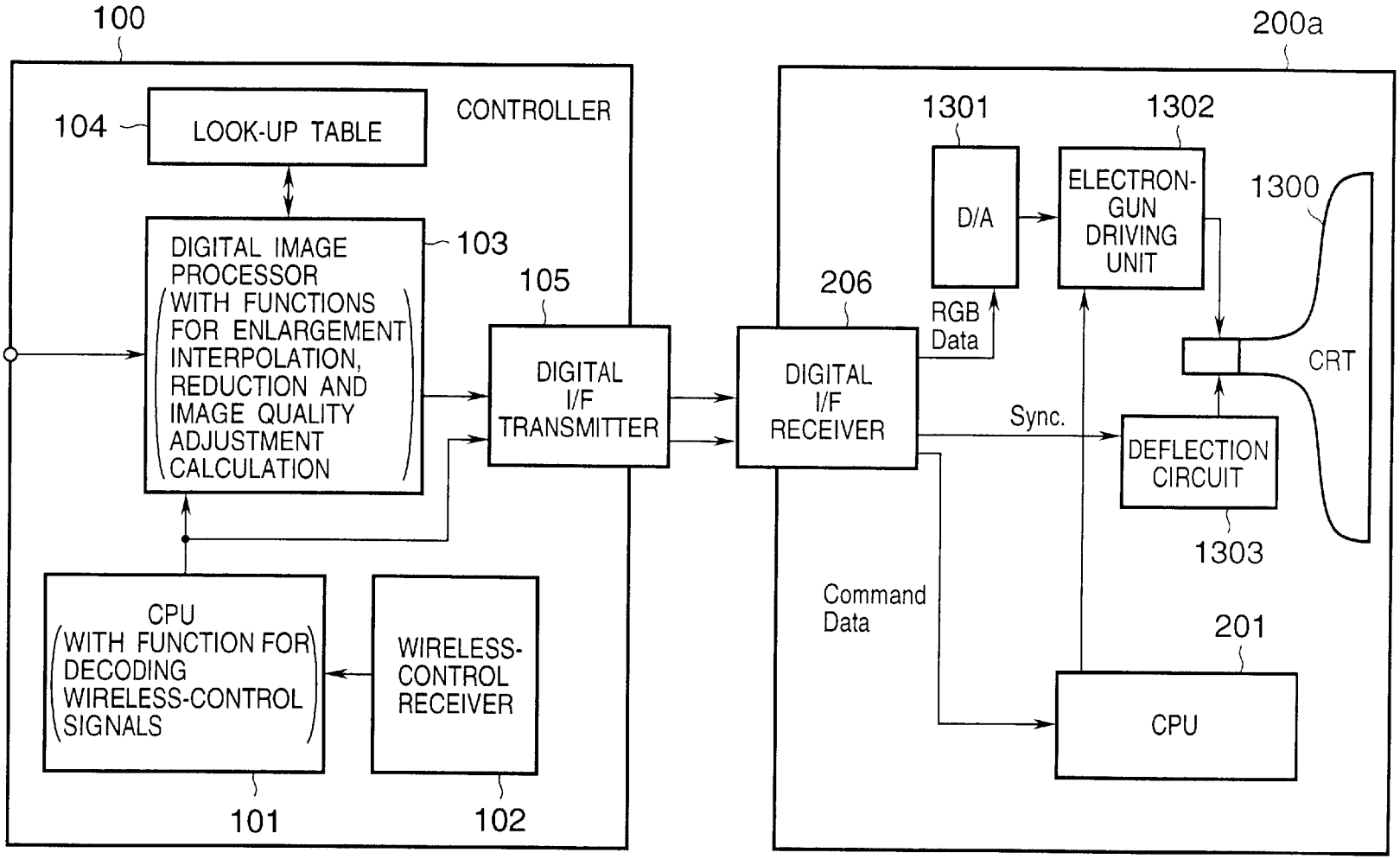
FIG. 13 is a block diagram illustrating the construction of an image display apparatus according to a third embodiment of the present invention.

FIG. 13 is a block diagram illustrating the construction of a display apparatus according to a third embodiment of the present invention. Components shown in FIG. 13 identical with those of FIG. 1 are designated by like reference characters and need not be described again.

In the third embodiment, the controller 100 is the same as that of the first embodiment. This embodiment differs from the first in that a display unit 200*a* includes a CRT 1300.

In the display unit 200*a*, a D/A converter 1301 converts digital RGB data from the digital interface receiver 206 to an analog signal and outputs the analog signal to an electron-gun driving unit 1302. In accordance with a synchronizing signal input from the receiver 206, a deflection circuit 1303 deflects an electron beam output in response to a drive signal a supplied by the electron-gun driving unit 1302. A CPU 201*a*, to which a command and data received by the receiver 206 are input, controls the electron-gun driving unit 1302 in dependence upon the command to adjust the image quality of an image displayed on the CRT 1300. More specifically, in accordance with adjustment data that has been received, the CPU 201*a* controls brightness by applying a current-value offset in the electron-gun driving unit 1302, adjusts contrast by regulating the amplitude of the driving signal from the electron-gun driving unit 1302, or adjusts color temperature by holding fixed the G-component drive signal of the image signal and changing the balance of the driving current values of the R and B components.

Other components and operations are similar to those of the first embodiment and need not be described again. Thus, the present invention can be applied and effect similar to those of the foregoing embodiment can be obtained even when the display unit employs a CRT.

Fourth Embodiment

Figure 14:
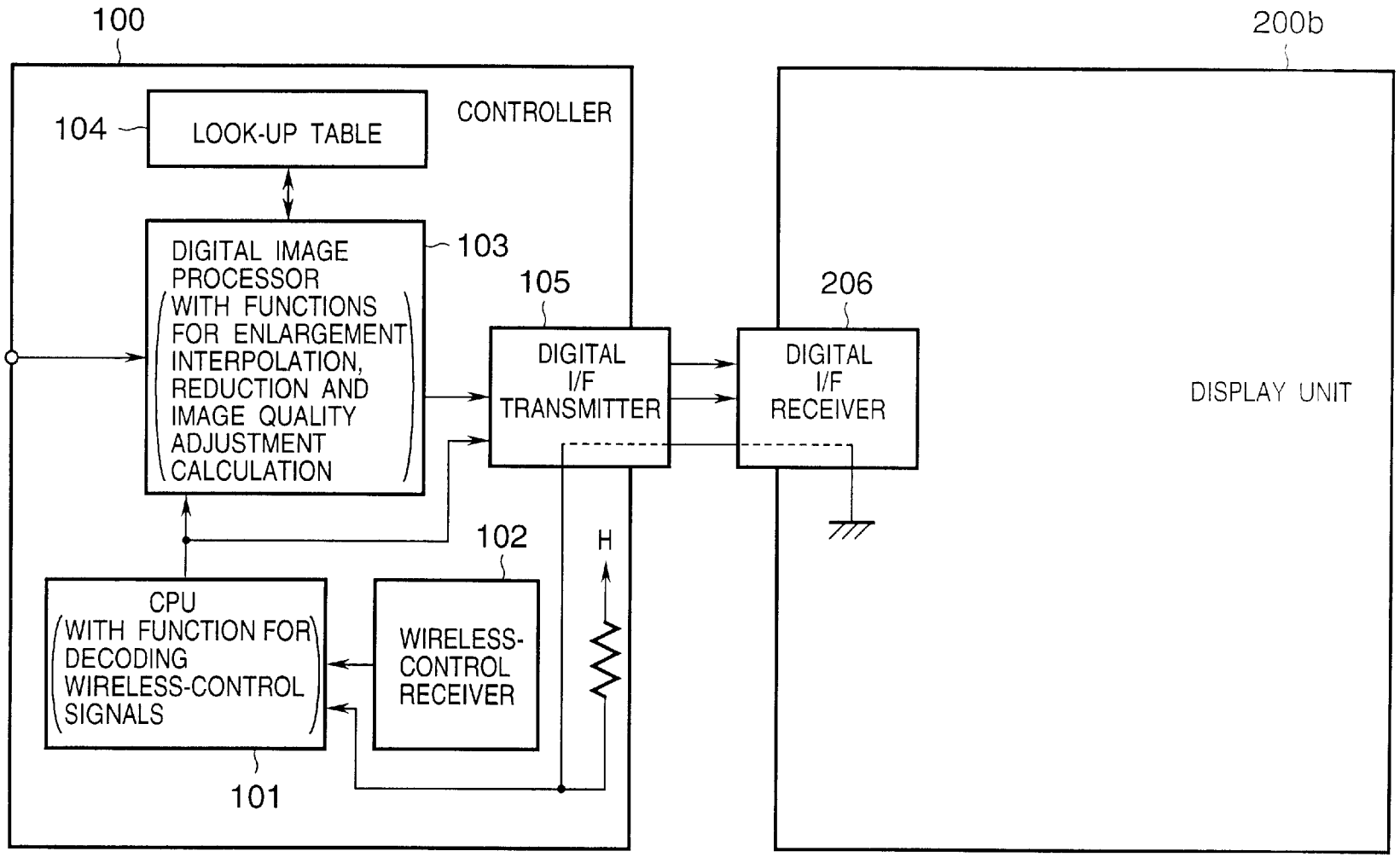
FIG. 14 is a block diagram illustrating the construction of an image display apparatus according to a fourth embodiment of the present invention.

FIG. 14 is a block diagram illustrating the construction of a display apparatus according to a fourth embodiment of the present invention. Components shown in FIG. 14 identical with those of FIG. 1 are designated by like reference characters and need not be described,again. The fourth embodiment illustrates a case in which a display unit 200*b* is not equipped with functions for adjusting brightness, contrast and color temperature, etc.

The controller 100 according to the fourth embodiment determines whether the connected display unit 200*b* is one having an image quality adjustment function on the basis of an exchange of data with the display unit 200*b* via the digital interface transmitter 105 and receiver 206 or based upon the signal level of a pin in a terminal for the digital interface. If it is determined that the connected display unit 200*b* does possess an image quality adjustment function, then, in a manner similar to that of the first embodiment, the controller 100 determines whether designation information entered from a wireless controller is indicative of content to be processed by the controller 100 or content to be processed by the display unit 200*b*, creates the corresponding commands and executes processing in which the digital image processor 103 is instructed to execute the image quality adjustment or a command is sent to the display unit 200*b* and this is instructed to execute processing.

The processing described above is illustrated in the flowchart of FIG. 15, in which processing similar to that of FIG. 3 is designated by like step numbers and need not be described again in detail.

Figure 15:
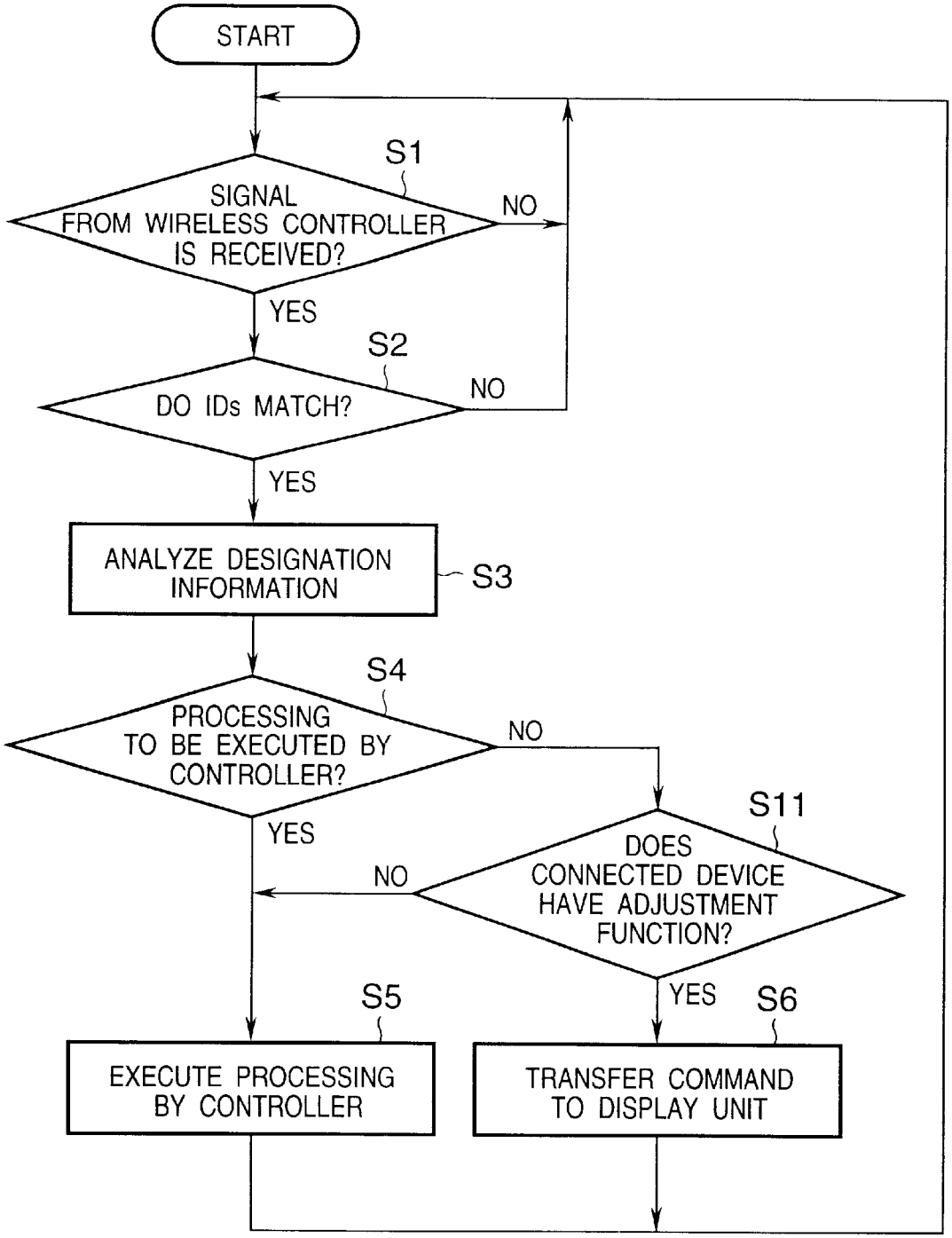
FIG. 15 is a flowchart illustrating processing executed by a controller of the image display apparatus according to the fourth embodiment.

If it is determined at step S4 in FIG. 15 that content is not such that is processed by the controller 100, control proceeds to step S11, at which it is determined whether the connected display unit 200*b* is one having an adjustment function or not. As mentioned above, this may involve recognition based upon exchange of commands with the display unit 200*b* or may be judged by the level of a specific signal line in the interface between the transmitter 105 and receiver 206. If the connected display unit 200*b* is one having an image quality adjustment function, then control proceeds to step S6, at which a command conforming to the indicated designation information is created and sent to the display unit 200*b*.

In a case where the connected display unit 200*b* is one not provided with the image quality adjustment function, control proceeds to step S5. Here the digital image processor 103 executes processing relating also to brightness, contrast and color temperature, etc., as shown in FIG. 2, and transmits the results to the display unit 200*b* via the digital interface.

Thus, in accordance with the fourth embodiment, an image quality adjustment conforming to operation of a wireless controller by a user can be performed even in a case where a display unit devoid of an image quality adjustment function is connected to the controller.

Fifth Embodiment

Figure 16:
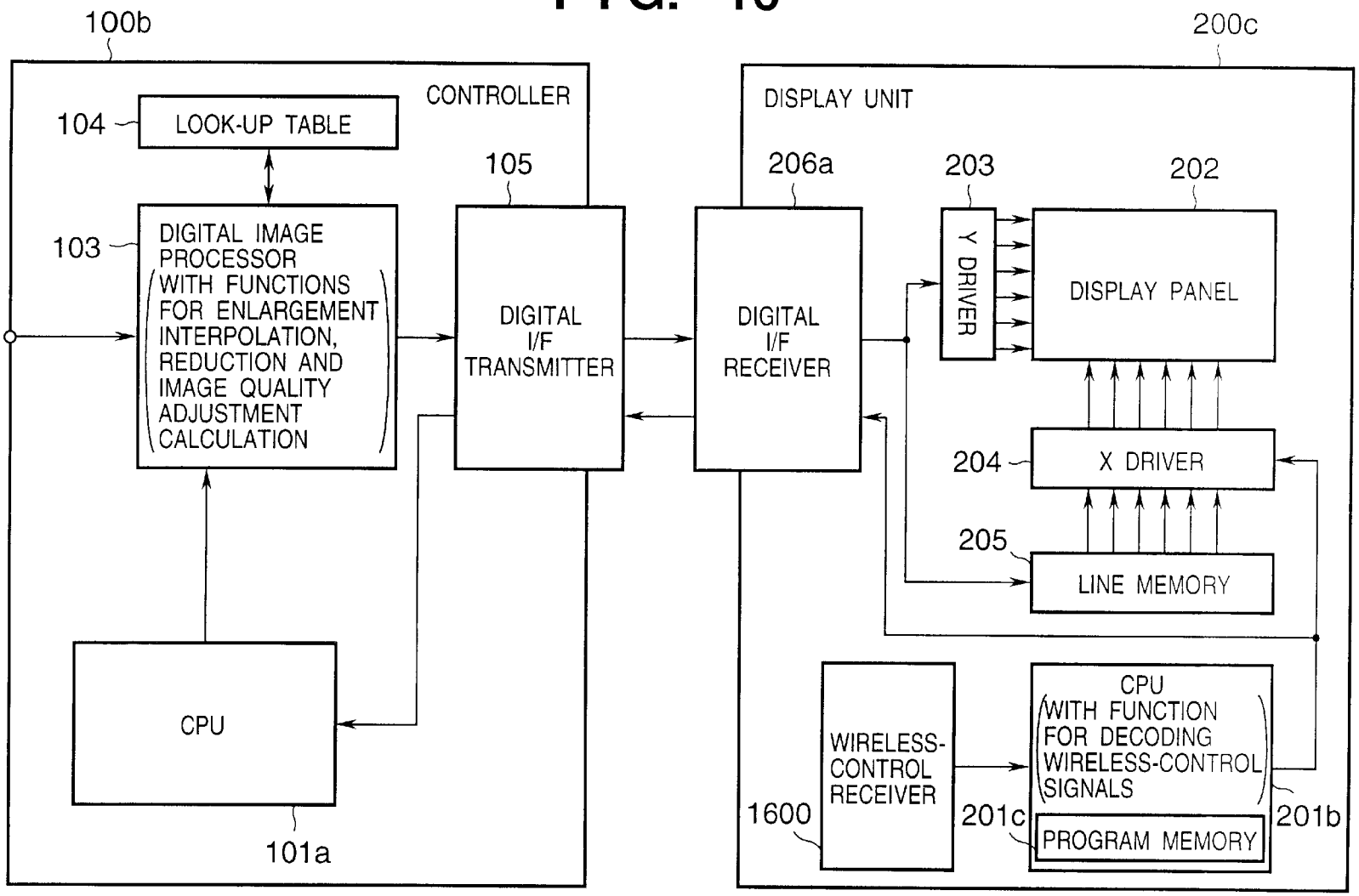
FIG. 16 is a block diagram illustrating the construction of an image display apparatus according to a fifth embodiment of the present invention.

FIG. 16 is a block diagram illustrating the construction of a display apparatus according to a fifth embodiment of the present invention. Components shown in FIG. 15 identical with those of FIG. 1 are designated by like reference characters and need not be described again. According to the fifth embodiment, a display unit 200*c* has a construction basically the same as that of the display unit 200 described above. However, the display unit 200*c* differs in that it is provided with a wireless-control receiver 1600 and in that the CPU 201*b* has a function for decoding designation information from a wireless controller. A program memory 201*c* stores the control program of the CPU 201*b*. Unlike the CPU 101 of the foregoing embodiment, the CPU 201*a* of the controller 100*b* does not possess a function for decoding the designation information from a wireless controller. Further, a digital dedicated line between the digital interface transmitter 105 and receiver 206*a* is bidirectional.

Figure 17:
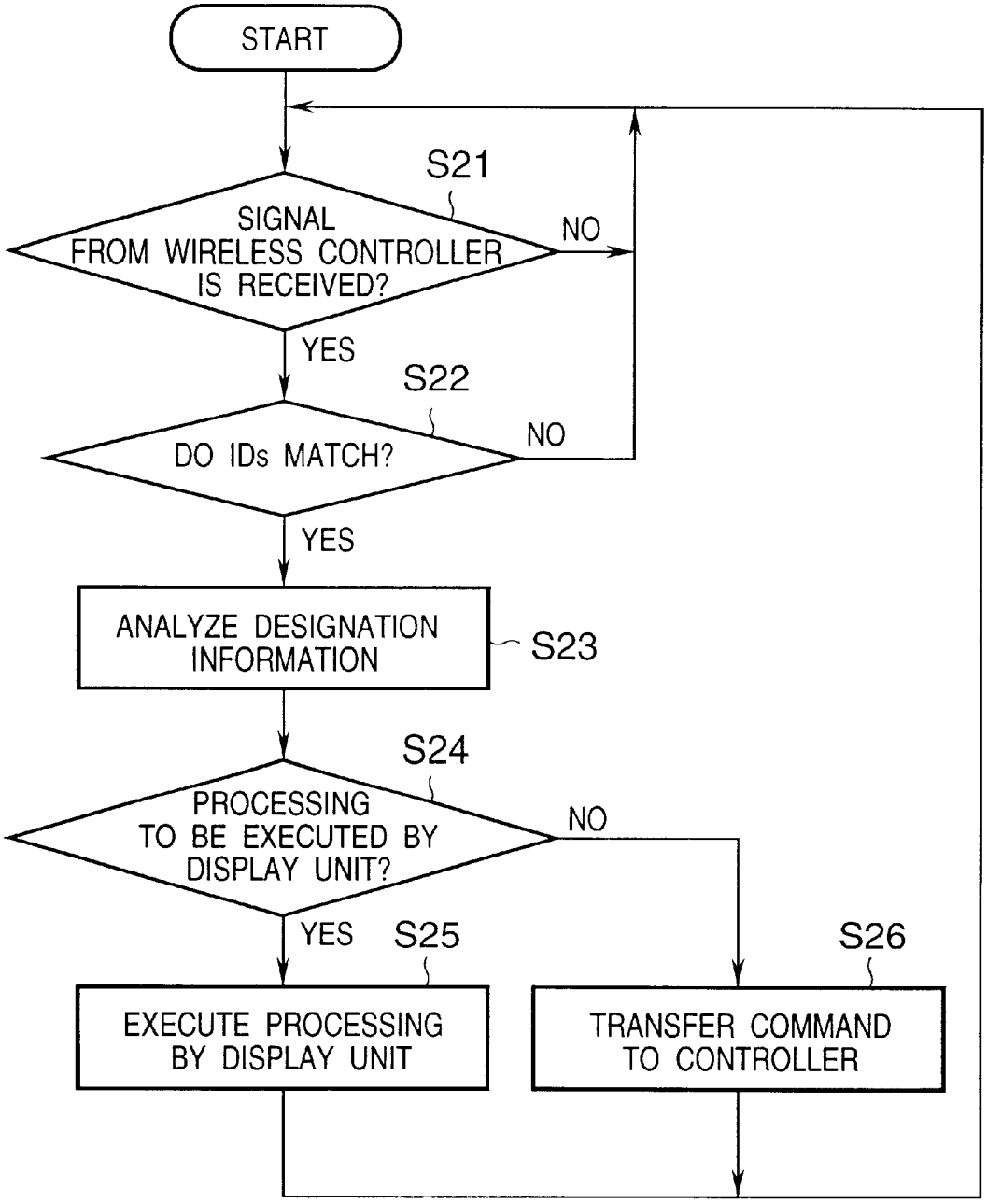
FIG. 17 is a flowchart illustrating processing executed by a display unit of the image display apparatus according to the fifth embodiment.

FIG. 17 is a flowchart illustrating control processing executed by the CPU 201*b* of the display unit 200*c* according to the fifth embodiment. The program for executing this processing is stored in the program memory 201*c*. It should be noted that the processing illustrated by this flowchart assumes that the CPU 201*b* of the display unit 200*c* has already recognized the type of the controller 100*b* connected to it.

Step S21 of the flowchart calls for the CPU 201*b* to determine whether a signal has been received by the wireless-control receiver 1600. If a signal has been received, control proceeds to step S22, at which the CPU 201*b* determines whether the ID contained in the wireless-control signal matches a wireless-controller ID capable of being received by the display unit 200*c*. If the two do not match, control returns to step S21 without execution of any further processing. If a match is obtained, however, control proceeds to step S23, at which designation information contained in the wireless-control signal is analyzed. This is followed by step S24, at which the CPU 201*b* determines whether the designation made by the wireless controller is designation of a brightness, contrast and color-temperature adjustment, for example, to be executed by the display unit 200*c*. If such is the case, adjustment information is stored in the memory (not shown) of the CPU 201*b* and control proceeds to step S25 because it is judged that the adjustments are to be made by the display unit 200*c*. In the manner described earlier, here the output of the X-driver 204 is controlled to perform an adjustment in such a manner that the designated brightness, contrast and color temperature, etc., will be obtained.

If it is judged at step S24 that the designation from the wireless controller is a designation relating to an image quality adjustment of chromaticity, hue or contour emphasis that is not processed by the display unit 200*c*, control proceeds to step S26 by reason of the fact that execution of such processing by the controller 100*b* is appropriate. This designation information is stored in the memory (not shown) of the CPU 101*b* and the designation information is converted to command data which is then sent to the transmitter 105 of the controller 100*b* via the digital interface receiver 206*a*. As a result, the CPU 101*a* of the controller 100*a* accepts this command and controls the digital image processor 103 in conformity with the designated content to convert the image signal.

The effects obtained by the operation described above are similar to those of the first embodiment.

Sixth Embodiment

Figure 18:
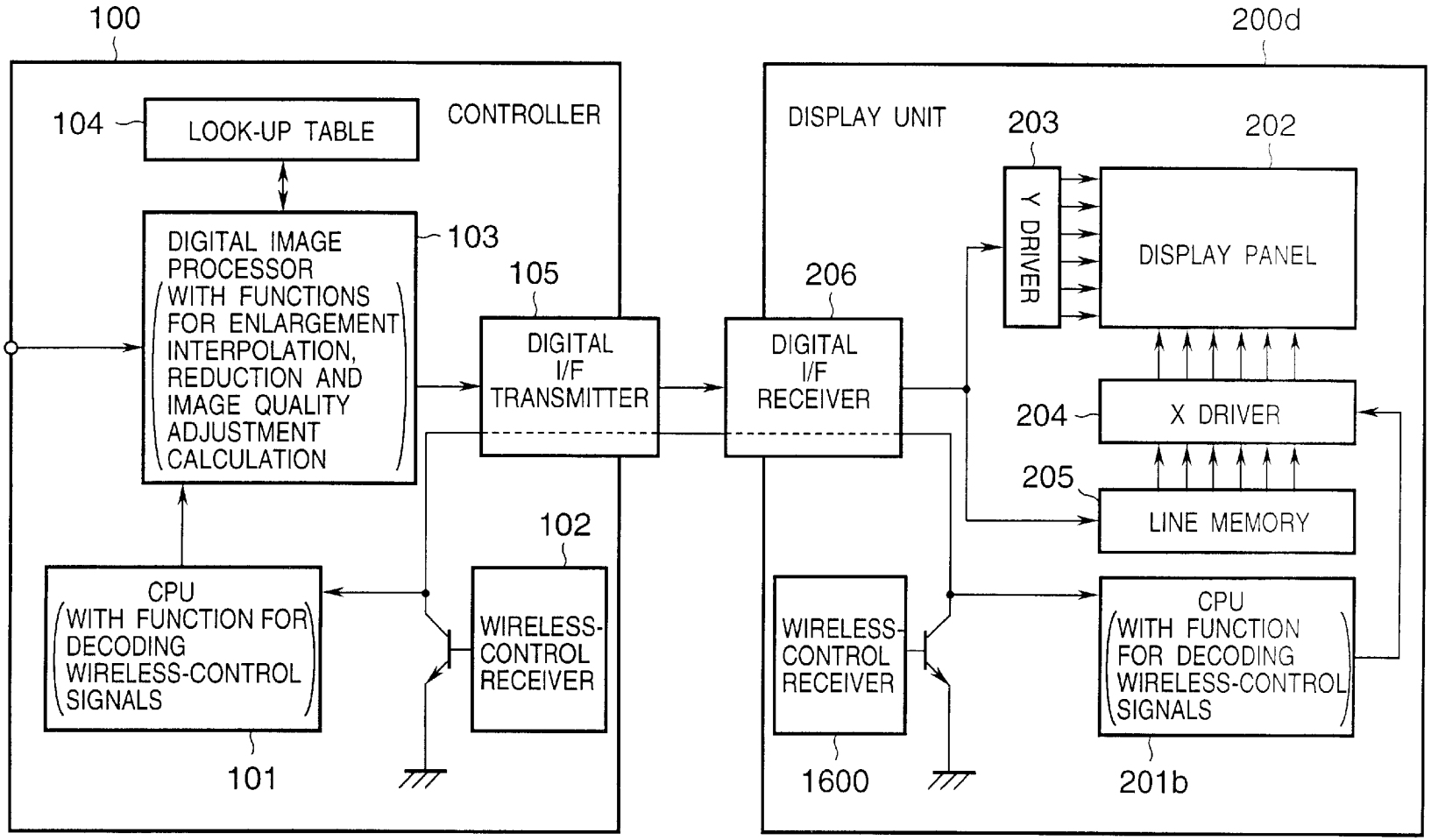
FIG. 18 is a block diagram illustrating the construction of an image display apparatus according to a sixth embodiment of the present invention.

FIG. 18 is a block diagram illustrating the construction of a display apparatus according to a sixth embodiment of the present invention. Components shown in FIG. 18 identical with those of the foregoing embodiments are designated by like reference characters and need not be described again. The sixth embodiment differs in that the controller 100 and a display unit 200*d* have wireless-control receivers 102 and 1600, respectively, and a function for decoding wireless-control information received by the respective receiver.

In the arrangement of FIG. 18, the outputs of the wireless-control receivers 102, 1600 are connected in a wired OR via a digital dedicated line. When a signal is received by either of the wireless-control receivers, therefore, the wireless-control information can be input by both the controller 100 and the display unit 200*d*.

Figure 19:
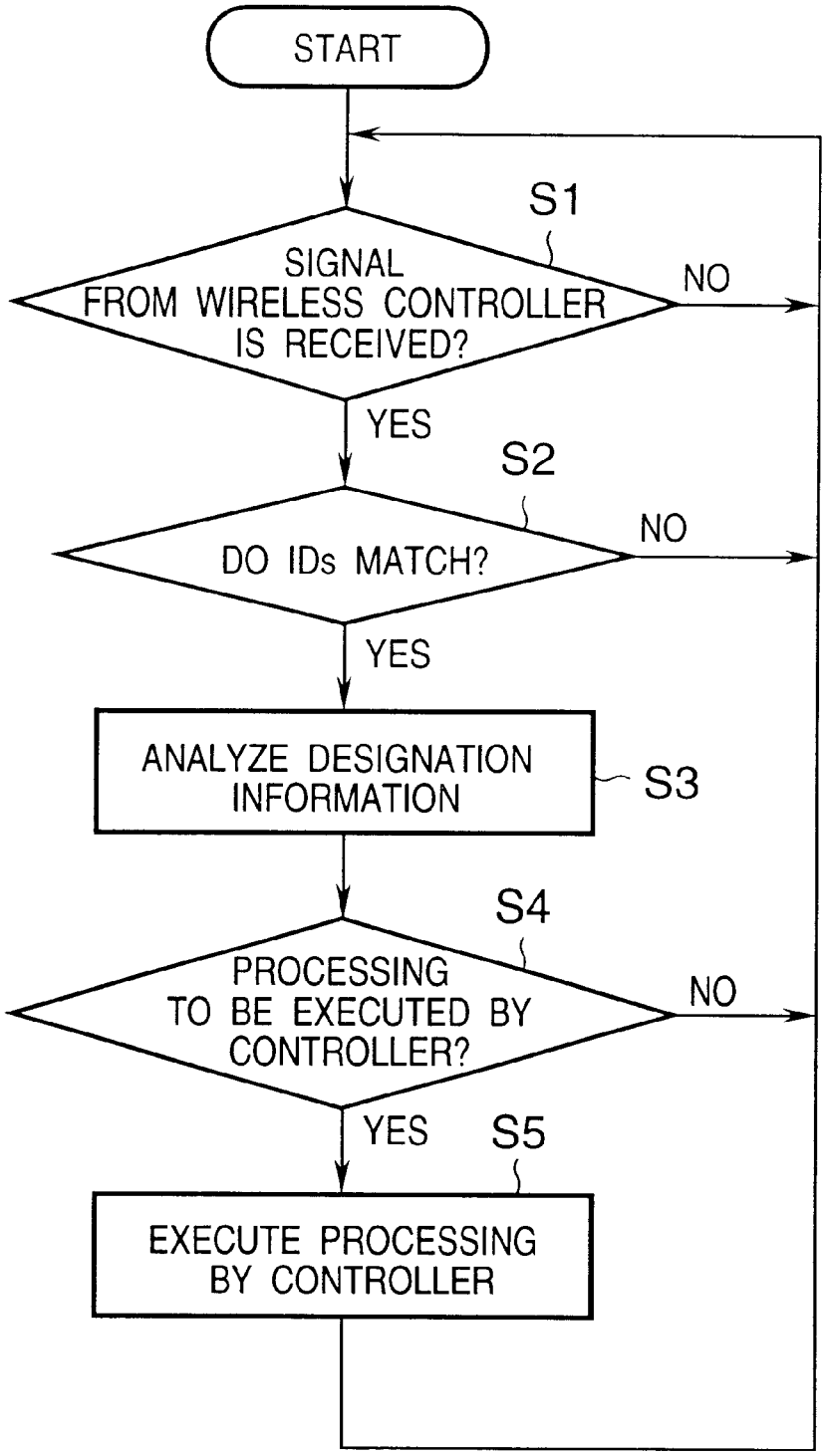
FIG. 19 is a flowchart illustrating processing executed by a controller of the image display apparatus according to the sixth embodiment.

FIG. 19 is a flowchart illustrating processing executed by the CPU 101 of the controller 100 according to the sixth embodiment. As should be evident by referring to the flowchart of FIG. 3, the processing of FIG. 19 is exactly the same as that of FIG. 3 except for step S4. If the determination made at step S4 in FIG. 19 is that the designated information is not processed by the controller 200, no processing is executed. The other steps of FIG. 19 have already been described.

Figure 20:
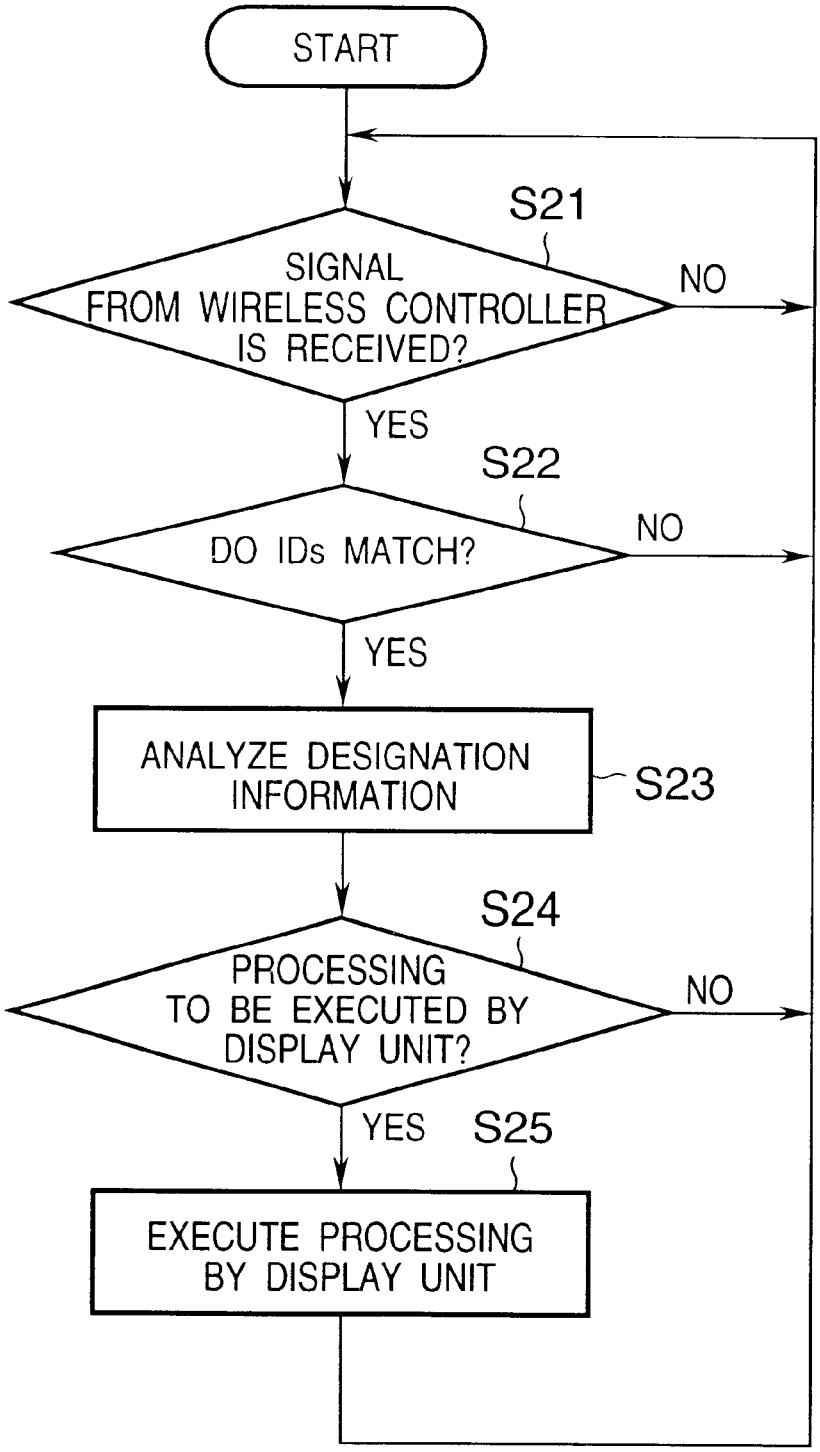
FIG. 20 is a flowchart illustrating processing executed by a display unit of the image display apparatus according to the sixth embodiment.

FIG. 20 is a flowchart illustrating processing executed by the CPU 201*b* of display unit 200*d* according to the sixth embodiment. As should be evident by referring to the flowchart of FIG. 17, the processing of FIG. 20 is exactly the same as that of FIG. 17 except for step S24. If the determination made at step S24 in FIG. 20 is that the designated information is not processed by the display unit 200*d*, no processing is executed. The other steps of FIG. 20 have already been described.

Thus, in accordance with this arrangement, if either the controller 100 or display unit 200*d* is placed at a location that cannot be reached by infrared light from a wireless controller, control can still be carried out by receiving the wireless-controller signal using the other device.

In each of the foregoing embodiments, the controller and the display unit are illustrated as being separate from each other. However, this does not impose a limitation upon the present invention. For example, the display apparatus may be one in which the controller and display unit are integrated into a single body.

The present invention can be applied to a system constituted by a plurality of devices (e.g., a host computer, interface, reader, printer, etc.) or to an apparatus comprising a single device (e.g., a copier or facsimile machine, etc.).

Furthermore, it goes without saying that the object of the invention is attained also by supplying a storage medium storing the program codes of the software for performing the functions of the foregoing embodiments to a system or an apparatus, reading the program codes with a computer (e.g., a CPU or MPU) of the system or apparatus from the storage medium, and then executing the program codes.

In this case, the program codes read from the storage medium implement the novel functions of the invention, and the storage medium storing the program codes constitutes the invention.

Further, the storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiments are implemented by executing the program codes read by a computer, it goes without saying that the present invention covers a case where an operating system or the like running on the computer performs a part of or the entire process in accordance with the designation of program codes and implements the functions according to the embodiments.

It goes without saying that the present invention further covers a case where, after the program codes read from the storage medium are written in a function expansion board inserted into the computer or in a memory provided in a function expansion unit connected to the computer, a CPU or the like contained in the function expansion board or function expansion unit performs a part of or the entire process in accordance with the designation of program codes and implements the function of the above embodiment.

Thus, in accordance with the embodiments as described above, a controller and a display unit are each capable of executing image quality adjustment processing that conforms to the controller and display unit. This makes it possible to display a high-quality image without increasing the scale of the circuitry and without raising the cost of hardware.

The present invention is not limited to the above embodiments and various changes can be made within the spirit and scope of the present invention. Therefore, to apprise the public of the scope of the present invention, the following claims are made.

What is claimed is:

1. An image display control apparatus for outputting an image signal to a display unit to display an image on the display unit, wherein the display unit has an image quality adjusting function that adjusts the image signal based on a first image quality adjustment, said apparatus comprising:

an input device adapted to receive an image quality adjustment designation, which includes a first or a second image quality adjustment, to designate an image quality adjustment of an image to be displayed on the display unit, wherein the first image quality adjustment is performed in the display unit and the second image quality adjustment is performed in said image display control apparatus;

a control circuit adapted to convert the first image quality adjustment to a command signal, in a case in which said input device receives the image quality adjustment designation including the first image quality adjustment;

an image processing circuit adapted to perform an image processing on an inputted image signal, so as to adjust an image quality of an image to be displayed on the display unit based on the second image quality adjustment, and to output a processed image signal, in a case in which said input device receives the image quality adjustment signal including the second image quality adjustment; and an output device adapted to output, to the display unit, either (i) the command signal converted by said control circuit and the inputted image signal, or (ii) the processed image signal outputted by said image processing circuit.

2. The apparatus according to claim 1, wherein the image signal includes R, G, B signals and each of the R, G, B signals may be processed independently to execute the designated image quality adjustment.

3. The apparatus according to claim 1, wherein the first image quality adjustment is an adjustment of at least one of brightness, contrast and color temperature.

4. The apparatus according to claim 1, wherein the second image quality adjustment includes a change of at least one of chromaticity, hue and emphasis of contour.

5. The apparatus according to claim 1, wherein the display unit has a display panel, which includes surface-conduction type emission devices.

6. The apparatus according to claim 1, wherein the display unit includes a CRT.

7. The apparatus according to claim 1, wherein said input device receives information, which is specified by a wireless controller, by infrared light and inputs this information.

8. The apparatus according to claim 1, wherein the display unit includes:

a command analysis circuit adapted to analyze a command that has been transmitted by said control circuit; and an image quality adjustment circuit adapted to perform an image quality adjustment based upon the command analyzed by the command analysis circuit by changing a pulse width of a display driving signal.

9. The apparatus according to claim 1, wherein the display unit includes:

a command analysis circuit adapted to analyze a command that has been transmitted by said control circuit; and an image quality adjustment circuit adapted to perform an image quality adjustment based upon the command analyzed by the command analysis circuit by changing a driving current of a display driving signal.

10. The apparatus according to claim 1, wherein the display unit includes:

a command analysis circuit adapted to analyze a command that has been transmitted by said control circuit; and an image quality adjustment circuit adapted to perform an image quality adjustment based upon the command analyzed by the command analysis circuit by changing a number of pulses of a display driving signal.

11. The image display control apparatus according to claim 1, wherein the display unit comprises:

an electron-source substrate on which a plurality of electron emission devices are arrayed;

a rear plate, to which the electron-source substrate is secured; and a face plate obtained by forming a phosphor film and a metal back on an inner surface of a glass substrate.

12. The image display control apparatus according to claim 11, wherein the rear plate and the face plate are secured to a support frame using frit glass.

13. The image display control apparatus according to claim 11, wherein the display unit further comprises an envelope constructed by the face plate, a support plate and the rear plate.

14. The image display control apparatus according to claim 11, wherein the display unit further comprises:

a vacuum vessel housing the electron emission device; and an exhaust pump.

15. The image display control apparatus according to claim 11, wherein the electron emission device has an emission current such that when an element voltage is equal to or exceeds a threshold voltage the emission current increases and when the element voltage is less than the threshold voltage the emission current decreases.

16. The image display control apparatus according to claim 11, wherein the electron emission device is a non-linear element having a threshold voltage relative to an emission current.

17. The image display control apparatus according to claim 16 wherein the electron emission device includes an electron-gun driving unit.

18. A display apparatus comprised of a display controller and a display unit for outputting an image signal from said display controller to said display unit to display an image based on the image signal, wherein said display controller comprises:

an input device adapted to receive an image quality adjustment designation, which includes a first or second image quality adjustment, for designating an image quality adjustment of an image to be displayed on said display unit, wherein the first image quality adjustment is performed in said display unit and the second image quality adjustment is performed in said display controller;

a control circuit adapted to convert the first image quality adjustment to a command signal, in a case in which the input device receives the image quality adjustment designation including the first image quality adjustment;

an image processing circuit adapted to perform an image processing on an inputted image signal, so as to adjust an image quality of an image to be displayed on said display unit based on the second image quality adjustment, and to output a processed image signal, in a case in which the input device receives the image quality adjustment designation including the second image quality adjustment; and an output device adapted to output, to said display unit, either (i) the command signal converted by the control circuit and the inputted image signal, or (ii) the processed image signal outputted by the image processing circuit, and wherein said display unit comprises:

a receiving unit adapted to receive (i) the command signal and the inputted image signal, or (ii) the processed image signal outputted by the output device;

an image quality adjusting circuit adapted to perform the first image quality adjustment on the inputted image signal received by the receiving unit, based on the command signal received by the receiving unit; and a display screen adapted to display an image in accordance with the image signal adjusted by the image quality adjusting circuit or the processed image signal.

19. The apparatus according to claim 18, wherein the image quality adjusting circuit performs the first image quality adjustment by changing a pulse width of a display driving signal.

20. The apparatus according to claim 18, wherein the image quality adjusting circuit performs the first image quality adjustment by changing a driving current of a display driving signal.

21. The apparatus according to claim 18, wherein the image quality adjusting circuit performs the first image quality adjustment by changing a number of pulses of a display driving signal.

22. An image display control method for outputting an image signal from a display controller to a display unit to display an image on the display unit, said method comprising:

an input step of inputting an image quality adjustment designation that includes a first or a second image quality adjustment for designating an image quality adjustment of an image to be displayed on the display unit, wherein the first image quality adjustment is performed in the display unit and the second image quality adjustment is performed in the display controller;

a command conversion step of converting the first image quality adjustment into a command signal, in a case in which the image quality adjustment designation including the first image quality adjustment is received in said input step;

an image processing step of performing an image processing on an inputted image signal, so as to adjust an image quality of an image to be displayed on the display unit based on the second image quality adjustment, in a case in which the image quality adjustment designation including the second image quality adjustment is received in said input step; and an output step of outputting, to the display unit, either (i) the processed image signal processed in said image processing step or (ii) the inputted image signal and the command signal converted in said command conversion step.

23. The method according to claim 22, wherein the image signal includes R, G, B signals and each of the R, G, B signals may be processed independently to execute the designated image quality adjustment.

24. The method according to claim 22, wherein said input step receives information, which is specified by a wireless controller, by infrared light and inputs this information.

25. The method according to claim 22, wherein the display unit is adjustable with respect to at least one of brightness, contrast and color temperature.

26. A computer-readable storage medium storing a control program adapted to execute an image display control method for outputting an image signal from a display controller to a display unit to display an image on the display unit, the program comprising:

an input-step module for inputting an image quality adjustment designation, which includes a first or a second image quality adjustment, to designate an image quality adjustment of an image to be displayed on the display unit, wherein the first image quality adjustment is performed in the display unit and the second image quality adjustment is performed in the display controller;

a command-conversion-step module for converting the first image quality adjustment to a command signal, in a case in which the image quality adjustment designation including the first image quality adjustment is received by said input-step module;

an image-processing-step module for performing an image processing on an inputted image signal, so as to adjust an image quality of an image to be displayed on the display unit based on the second image quality adjustment, in a case in which the image quality adjustment designation including the second image quality adjustment is received by said input-step module; and an output-step module for outputting from the display controller to the display unit either (i) the command signal converted by said command-conversion-step module and the inputted image signal, or (ii) the processed image signal processed by said image-processing-step module.

27. The storage medium according to claim 26, wherein the image signal includes R, G, B signals and each of the R, G, B signals may be processed independently to execute the designated image quality adjustment.

28. The storage medium according to claim 26, wherein said input-step module receives information, which is specified by a wireless controller, by infrared light and inputs this information.

29. An image display control method for outputting an image signal from a display controller to a display unit to display an image on the display unit, said method comprising:

an input step of receiving an image quality adjustment designation, which includes a first or a second image quality adjustment, to designate an image quality adjustment of an image to be displayed on the display unit, wherein the first image quality adjustment is performed in the delay unit and the second image quality adjustment is performed in the display controller;

a control step of converting the first image quality adjustment to a command signal, in a case in which the image adjustment designation including the first image quality adjustment is received in said input step;

an image processing step of performing an image processing on an inputted image signal so as to adjust an image quality based on the second image quality adjustment, in a case in which the image adjustment designation including the second image quality adjustment is received in aid input step;

an output step of outputting from the display controller to the display unit either (i) the command signal converted in said control step and the inputted image signal, or (ii) the processed image signal processed in said image processing step;

a reception step of receiving (i) the command signal and the inputted image signal, or (ii) the processed image signal outputted in said output step; and an image quality adjusting step of performing the first quality adjustment on the input image signal received in said reception step, based on the command signal, so as to display an image on the display unit.

30. The method according to claim 29, wherein the image signal includes R, G, B signals and each of the R, G, B signals may be processed independently to execute the designated image quality adjustment.

31. The method according to claim 29, wherein the first image quality adjustment is an adjustment of at least one of brightness, contrast and color temperature.

32. The method according to claim 29, wherein the second image quality adjustment includes a change of at least one of chromaticity, hue and contour emphasis.

* * * * *

UNITED STATES PATENT AND TRADEMARK OFFICE

CERTIFICATE OF CORRECTION

PATENT NO. : 6,714,190 B2
DATED : March 30, 2004
INVENTOR(S) : Masaki Nakano

It is certified that error appears in the above-identified patent and that said Letters Patent is hereby corrected as shown below:

Column 4,
Line 60, "processing" should read -- processings --.

Column 7,
Line 5, "will having" should read -- will have --.

Column 9,
Line 62, "described," should read -- described --.

Column 14,
Line 45, "claim 16" should read -- claim 16, --.

Column 16,
Line 55, "delay" should read -- display --.
Line 67, "aid" should read -- said --.

Signed and Sealed this

Eighth Day of February, 2005

JON W. DUDAS
*Director of the United States Patent and Trademark Office*